US008573891B2

(12) United States Patent
Horton, III et al.

(10) Patent No.: US 8,573,891 B2
(45) Date of Patent: Nov. 5, 2013

(54) TENSION BUOYANT TOWER

(75) Inventors: Edward E. Horton, III, Houston, TX (US); James McCelvey, Houston, TX (US)

(73) Assignee: Horton Wison Deepwater, Inc., Houston, TX (US)

( * ) Notice: Subject to any disclaimer, the term of this patent is extended or adjusted under 35 U.S.C. 154(b) by 73 days.

(21) Appl. No.: 13/252,914

(22) Filed: Oct. 4, 2011

(65) Prior Publication Data

US 2012/0082514 A1 Apr. 5, 2012

Related U.S. Application Data

(60) Provisional application No. 61/389,577, filed on Oct. 4, 2010.

(51) Int. Cl.
*B63B 35/44* (2006.01)
*E02B 17/00* (2006.01)

(52) U.S. Cl.
USPC ..... 405/205; 405/224.1; 405/223.1

(58) Field of Classification Search
USPC ..... 405/195.1, 202, 203, 204, 205, 206, 405/208, 224, 224.1, 226, 223.1
See application file for complete search history.

(56) References Cited

U.S. PATENT DOCUMENTS 3,667,239 A * 6/1972 Mott ..... 405/202
3,708,985 A * 1/1973 Pogonowski et al. ..... 405/202
3,714,788 A * 2/1973 Mott ..... 405/205
3,899,990 A * 8/1975 Lecomte ..... 405/224
3,928,982 A * 12/1975 Lacroix ..... 405/224
4,086,866 A 5/1978 Nixon
4,126,010 A * 11/1978 Michel et al. ..... 405/202
4,126,011 A * 11/1978 Lamy et al. ..... 405/205
4,127,004 A * 11/1978 Vilain ..... 405/202
4,152,088 A * 5/1979 Vilain ..... 405/202
4,432,668 A * 2/1984 Rank ..... 405/202
4,493,283 A 1/1985 Elliott
4,511,287 A 4/1985 Horton
4,797,033 A * 1/1989 Pollack ..... 405/202
4,813,815 A * 3/1989 McGehee ..... 405/202
6,082,391 A * 7/2000 Thiebaud et al. ..... 405/224.1
6,135,673 A * 10/2000 Horton et al. ..... 405/205
6,273,018 B1 8/2001 Gottsche et al.
6,481,932 B1 * 11/2002 Riemers ..... 405/224.1
6,488,446 B1 * 12/2002 Riemers ..... 405/203
7,407,342 B2 * 8/2008 Seidel ..... 405/224.1
7,422,394 B2 * 9/2008 Koon et al. ..... 405/223.1
7,686,543 B2 * 3/2010 They ..... 405/224
2003/0221603 A1 12/2003 Horton
2008/0014025 A1 * 1/2008 They ..... 405/224

OTHER PUBLICATIONS

PCT/US2011/054794 International Search Report and Written Opinion dated Apr. 10, 2012 (10 p.).

* cited by examiner

*Primary Examiner* — Frederick L Lagman
(74) *Attorney, Agent, or Firm* — Conley Rose, P.C.

(57) ABSTRACT

An offshore structure comprises a base configured to be secured to the sea floor. In addition, the offshore structure comprises an elongate stem having a longitudinal axis, a first end distal the base and a second end pivotally coupled to the base. Further, the offshore structure comprises an upper module coupled to the first end of the stem. The upper module includes a variable ballast chamber. Still further, the offshore structure comprises a first ballast control conduit in fluid communication with the variable ballast chamber of the upper module. The first ballast control conduit is configured to supply a gas to the variable ballast chamber of the upper module and vent the gas from the variable ballast chamber of the upper module. Moreover, the offshore structure comprises a deck mounted to the upper module.

22 Claims, 24 Drawing Sheets

TENSION BUOYANT TOWER

CROSS-REFERENCE TO RELATED APPLICATIONS

This application claims benefit of U.S. provisional patent application Ser. No. 61/389,577 filed Oct. 4, 2010, and entitled "Tension Buoyant Tower," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to offshore structures to facilitate oil and gas production. More particularly, the invention relates to buoyant towers releasably coupled to the sea floor and configured to store and offload produced hydrocarbons.

2. Background of the Technology

Offshore structures are used to store and offload hydrocarbons (e.g., oil and gas) produced by subsea wells. Usually, the type of offshore structure employed will depend on the depth of water at the well location. For instance, in water depths less than about 300 feet, jackup platforms are commonly employed as production structures; in water depths between about 300 and 800 feet, fixed platforms are commonly employed as production structures; and in water depths greater than about 800 feet, floating systems such as semi-submersible platforms are commonly employed as production structures.

Jackup platforms can be moved between different wells and fields, and are height adjustable. However, jackup platforms are generally limited to water depths less than about 300 feet. Fixed platforms can be used in greater water depths than jackup platforms (up to about 800 feet), but are not easily moved and typically have a fixed height. Conventional floating production systems can be used in deep water, but are relatively difficult to move between different wells. In particular, most floating production systems are designed to be moored (via multiple mooring lines) at a specific location for an extended period of time. Such mooring systems typically include mooring lines that are anchored to the sea floor with relatively large piles driven into the sea bed. Such piles are difficult to handle, transport, and install at substantial water depths. Moreover, most floating productions systems are relatively expensive and cost prohibitive for smaller, marginal oil and gas fields.

Accordingly, there remains a need in the art for offshore structures and systems designed for use in water depths greater than about 800 feet and that are easily moveable between different offshore locations. Such offshore productions systems would be particularly well-received if they were economically feasible for smaller, marginal oil and gas fields.

BRIEF SUMMARY OF THE DISCLOSURE

These and other needs in the art are addressed in one embodiment by an offshore structure. In an embodiment, the offshore structure comprises a base configured to be secured to the sea floor. In addition, the offshore structure comprises an elongate stem having a longitudinal axis, a first end distal the base and a second end pivotally coupled to the base. Further, the offshore structure comprises an upper module coupled to the first end of the stem. The upper module includes a variable ballast chamber. Still further, the offshore structure comprises a first ballast control conduit in fluid communication with the variable ballast chamber of the upper module. The first ballast control conduit is configured to supply a gas to the variable ballast chamber of the upper module and vent the gas from the variable ballast chamber of the upper module. Moreover, the offshore structure comprises a deck mounted to the upper module.

These and other needs in the art are addressed in another embodiment by a method for producing one or more offshore wells. In an embodiment, the method comprises (a) transporting an elongate stem and an upper module offshore, wherein the upper module includes a variable ballast chamber. In addition, the method comprises (b) transitioning the stem from a horizontal orientation to a vertical orientation. Further, the method comprises (c) attaching the upper module to an upper end of the stem to form a tower. Still further, the method comprises (d) ballasting the tower. Moreover, the method comprises (e) pivotally coupling the tower to an anchor disposed at the sea floor at a first offshore installation site.

These and other needs in the art are addressed in another embodiment by an offshore structure. In an embodiment, the offshore structure comprises a tower having a longitudinal axis, an upper end, and a lower end opposite the upper end. The tower comprises an elongate stem extending from the lower end, an upper module coupled to the stem, and a deck mounted to the upper module at the upper end. The upper module is net buoyant. In addition, the offshore structure comprises an anchor configured to be secured to the sea floor. The anchor is pivotally and releasably coupled to the lower end of the tower.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
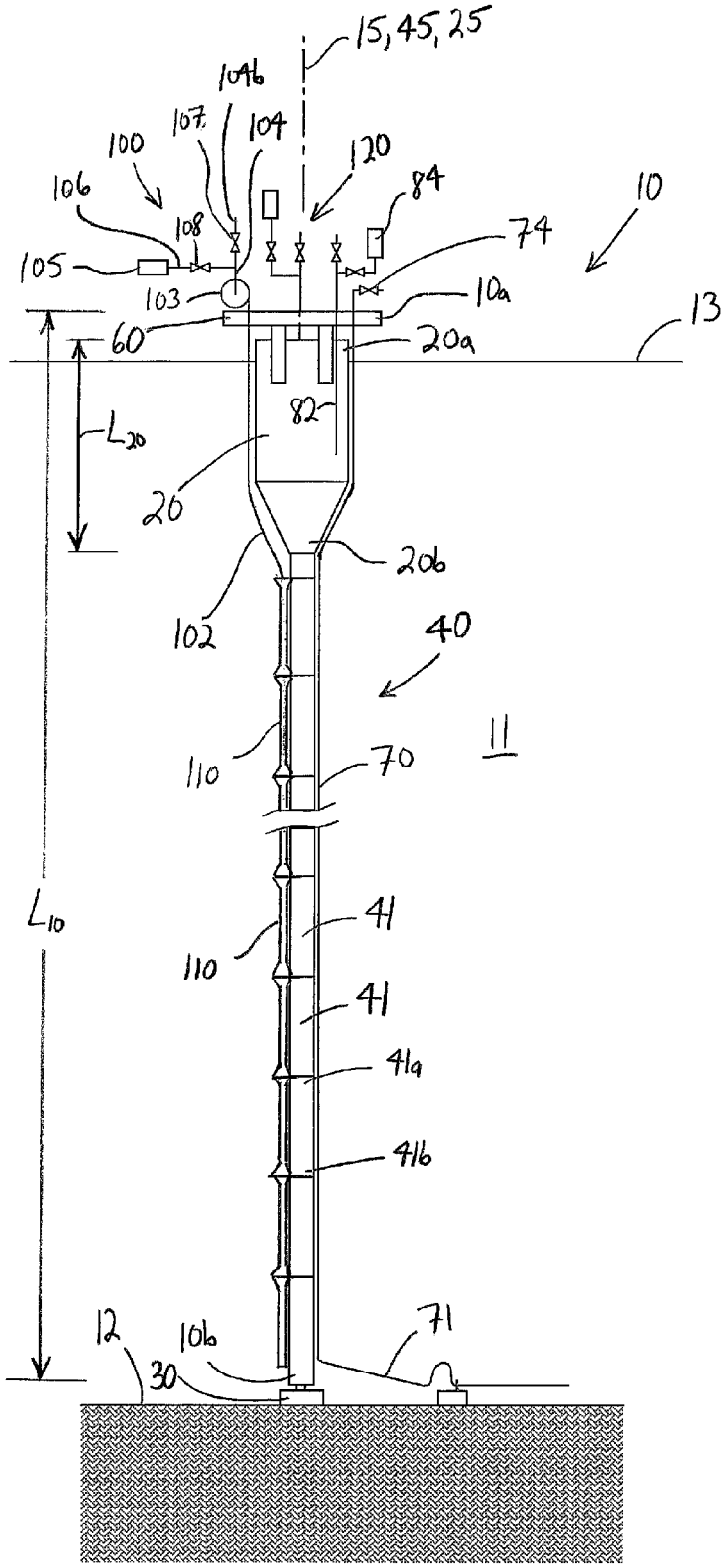
FIG. 1 is a front view of an embodiment of an offshore structure in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of an offshore production structure or buoyant tower 10 in accordance with the principles disclosed herein is shown deployed in a body of water 11 and releasably coupled to the sea floor 12 at an offshore site. In general, offshore structure 10 supports the production, storage, and offloading of hydrocarbons (e.g., oil and gas) produced from a subsea well or well field. Structure 10 has a central or longitudinal axis 15, a first or upper end 10*a* at or proximal the sea surface 13, and a second or lower end 10*b* releasably coupled to the sea floor 12 by an anchor or base 30. In this embodiment, structure 10 includes an upper module 20, a deck 60 mounted to module 20 at upper end 10*a*, and an elongate stem 40 extending from lower end 10*b* to upper module 20.

Structure 10 has a length $L_{10}$ measured axially between ends 10*a, b*. In this embodiment, upper module 20 extends above the sea surface 13, and thus, length $L_{10}$ is greater than the depth of water. However, in other embodiments, the upper module (e.g., upper module 20) and/or the deck (e.g., deck 60) may be disposed generally proximal but below the sea surface 13, in which case the axial length of the structure (e.g., length $L_{10}$ of structure 10) is less than the depth of the water.

Figure 2:
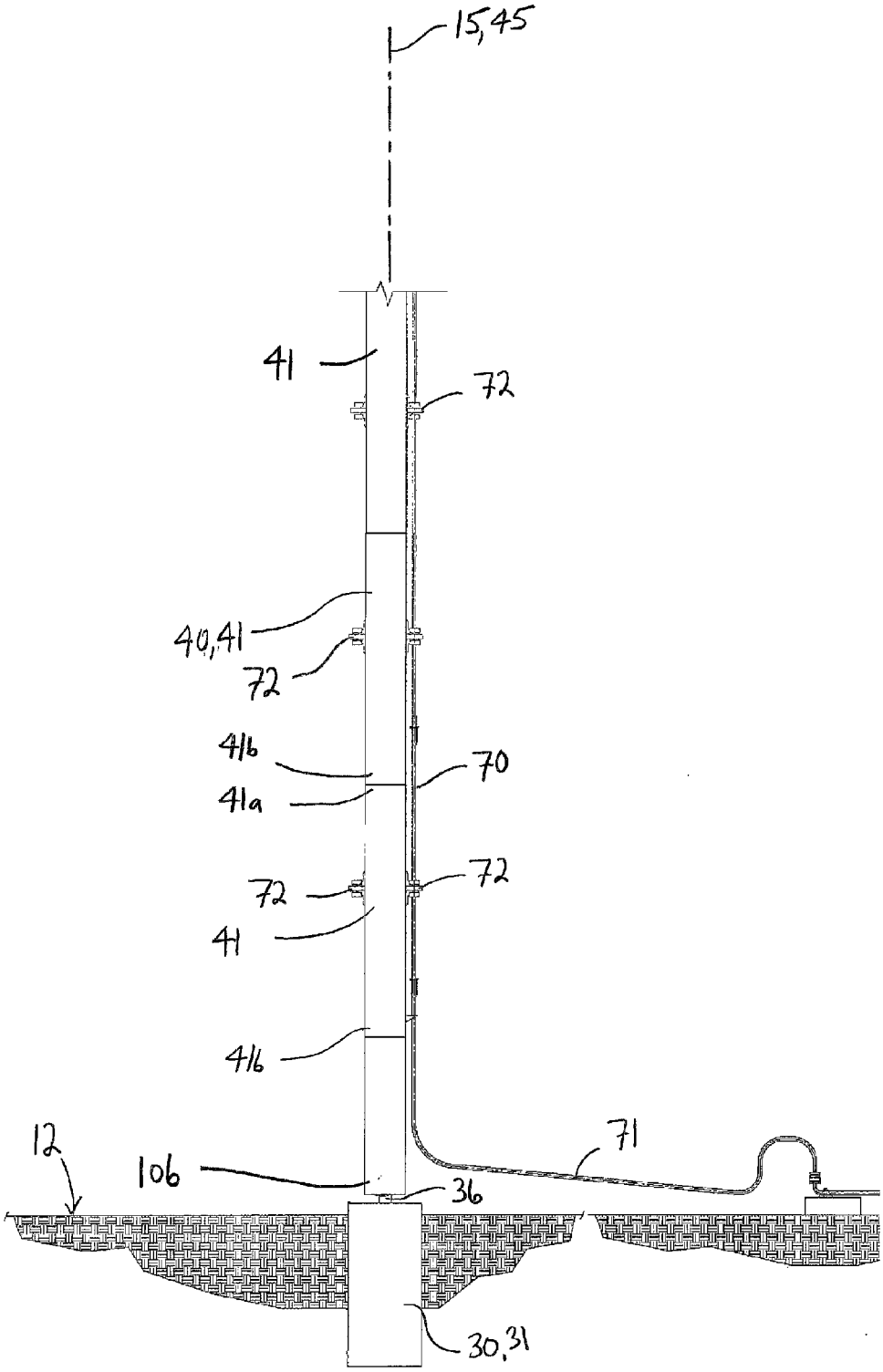
FIG. 2 is an enlarged front view of the lower portion of the offshore structure of FIG. 1.

Referring now to FIGS. 1 and 2, in this embodiment, stem 40 comprises a plurality of coaxially aligned, elongate cylindrical stem modules 41 connected together end-to-end. In particular, each stem module 41 has a central or longitudinal axis 45 coaxially aligned with axis 15, a first or upper end 41*a*, and a second or lower end 41*b* opposite end 41*a*. With the exception of the lowermost stem module 41 pivotally coupled to base 30 at its lower end 41*b*, and the uppermost stem module 41 coupled to transition module 50 at its upper end 41*a*, upper end 41*a* of each stem module 41 is coupled to the lower end 41*b* of an axially adjacent stem module 41. In general, axially adjacent stem modules 41 may be coupled end-to-end by any suitable means including, without limitation, a welded joint, bolts, etc. However, in embodiments described herein, adjacent stem modules 41 are preferably releasably coupled such that one or more modules 41 may be added or removed from stem 40 with relative ease to lengthen or shorten stem 40 based on the installation location and associated depth of water 11.

Figure 3:
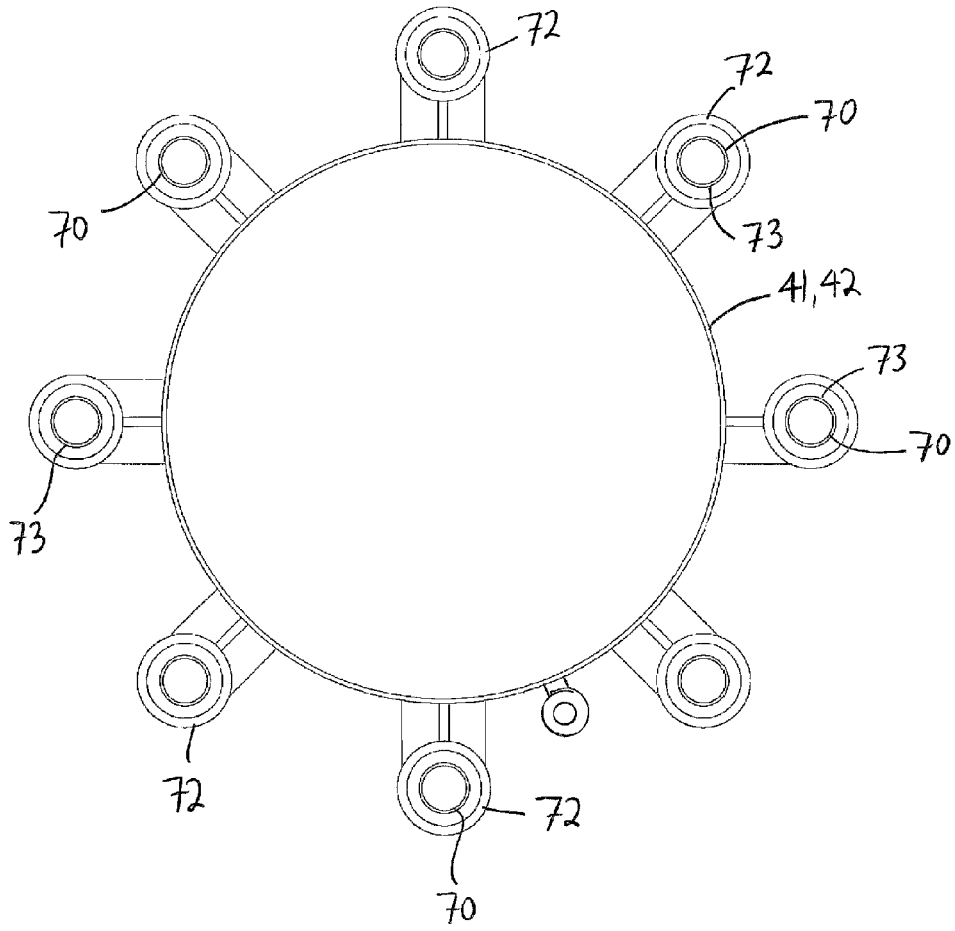
FIG. 3 is a cross-sectional top view of one of the stem modules of the offshore structure of FIG. 1.

Referring now to FIGS. 1-3, a plurality of production risers or conduits 70 extend from subsea export risers 71 at the sea floor 12 to deck 60 along the outside of structure 10. One production riser 70 is provided for each export riser 71. Each production riser 70 includes a valve 74 that controls the flow of produced hydrocarbons therethrough. Valves 74 may be actuated from deck 60 or remotely actuated. For purposes of clarity, only one export riser 71 and corresponding production riser 70 is shown in FIGS. 1 and 2. However, as shown in FIG. 3, a plurality of production conduits 70 may be supported by structure 10.

As best shown in FIGS. 2 and 3, production risers 70 are circumferentially spaced about structure 10 and coupled thereto with riser couplings or guides 72. In other words, each module 41 includes a plurality of circumferentially spaced guides 72 through which production risers 70 extend in route from the sea floor 12 and export risers 71 to deck 60. Each guide 72 extends radially outward from its corresponding module 41 and includes a through bore 73 that receives one conduit 70. Although FIG. 3 illustrates a plurality of circumferentially spaced guides 72 extending from one exemplary stem module 41, the remaining modules 41 are similarly configured, each module 41 including a plurality of circumferentially-spaced guides 72 for supporting conduits 70. Upper module 20 may also include a plurality of circumferentially spaced guides 72. Guides 72 on adjacent modules 20, 41 are circumferentially aligned to reduce and/or eliminate bends in risers 70.

Referring again to FIG. 1, during offshore production operations, produced hydrocarbons flow from export risers 71 through production conduits 70 to deck 60. With valves 74 opened, the produced hydrocarbons may be offloaded via production conduits 70 to a tanker or offloading vessel, a production platform, or combinations thereof. For example, structure 10 may offload produced hydrocarbons to a nearby floating production platform, which can temporarily store the produced hydrocarbons and offload the produced hydrocarbons to a tanker. Alternatively, structure 10 may offload produced hydrocarbons directly to a tanker. For example, a tanker may be positioned alongside deck 60, and placed in fluid communication with production conduits 70 extending from deck 60. If upper module 20 and deck 60 are disposed subsea (i.e., below the sea surface 13), the tanker may be positioned directly over the deck (e.g., deck 60) and placed in fluid communication with the production conduits (e.g., production conduits 70). It should also be appreciated that produced hydrocarbons could also be flowed to a hydrocarbon storage tank (disposed subsea or at the sea surface), and then offloaded from the storage tank to an offloading vessel, production platform, etc.

Figure 4:
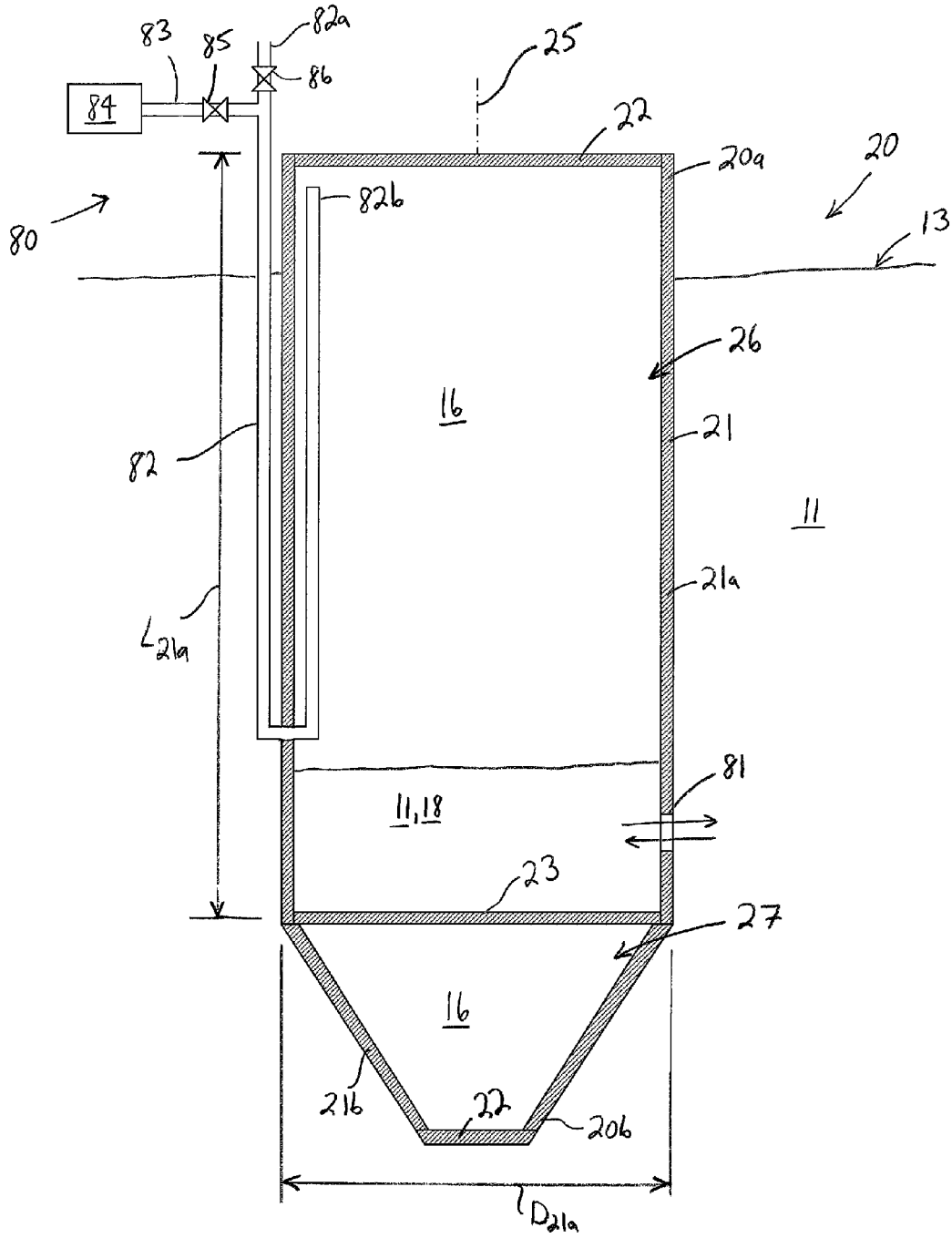
FIG. 4 is a schematic cross-sectional view of the upper module of the offshore structure of FIG. 1.

Referring now to FIGS. 1 and 4, upper module 20 has a central or longitudinal axis 25 coaxially aligned with axis 15, a first or upper end 20*a* coupled to deck 60, and a second or lower end 20*b* coupled to stem 40. In this embodiment, upper module 20 comprises a radially outer tubular 21 extending between ends 20*a, b*. Tubular 21 is divided into a first or upper cylindrical section 21*a* extending from upper end 20*a*, and a second or lower frustoconical section 21*b* extending from lower end 20*b* to cylindrical section 21*a*. In addition, upper module 20 includes upper and lower end walls or caps 22 at ends 20*a, b*, respectively, and a bulkhead 23 positioned within tubular 21 at the intersection of sections 21*a, b*. End caps 22 and bulkhead 23 are each oriented perpendicular to axis 25. Together, tubular 21, end walls 22, and bulkhead 23 define a plurality of axially stacked compartments or cells within module 20—a variable ballast or ballast adjustable chamber 26 within upper section 21*a* (axially disposed between upper cap 22 and bulkhead 23) and a buoyant chamber 27 disposed within section 21*b* (axially disposed between lower cap 22 and bulkhead 23).

End caps 22 close off ends 20*a, b* of module 20, thereby preventing fluid flow through ends 20*a, b* into chambers 26, 27, respectively. Bulkhead 23 is disposed between chambers 26, 27, thereby preventing fluid communication between adjacent chambers 26, 27. Thus, each chamber 26, 27 is isolated from the other chamber 26, 27 in module 20.

Upper module 20 has a length $L_{20}$ measured axially between ends 20*a, b*, and section 21*a* has a diameter $D_{21a}$ and length $L_{21a}$ measured axially between end 20*a* and section 21*b*. For an exemplary structure 10 deployed in 1,000 ft. of water and having a length $L_{10}$ of 1,000 ft., length $L_{20}$ is 250 ft., diameter $D_{21a}$ is 25 ft., and length $L_{21a}$ is 200 ft. However, depending on the particular installation location and desired dynamics for structure 10, lengths $L_{20}$, $L_{21a}$, and diameter $D_{21a}$ may be varied and adjusted as appropriate.

Chamber 27 is filled with a gas 16 and sealed from the surrounding environment (e.g., water 11), and thus, provide buoyancy to upper module 20 during offshore transport and installation of module 20, as well as during operation of structure 10. Accordingly, chamber 27 may also be referred to as a buoyant chamber. In this embodiment, gas 16 is air, and thus, may also be referred to as air 16. As will be described in more detail below, during offshore transport of upper module 20, variable ballast chamber 26 is also filled with air 16, thereby contributing to the buoyancy of module 20. However, during installation of module 20 and operation of structure 10, variable ballast 18 may be controllably added to ballast adjustable chamber 26 to decrease the buoyancy of module 20 and structure 10. In this embodiment, variable ballast 18 is water 11, and thus, variable ballast 18 may also be referred to as water 18.

Although module 20 includes two chambers 26, 27 in this embodiment, in general, module 20 may include any suitable number of chambers. Preferably, at least one chamber is an empty buoyant chamber and one chamber is a ballast adjustable chamber. Further, although end caps 22 and bulkhead 23 are described as providing fluid tight seals at the ends of chambers 26, 27, it should be appreciated that one or more end caps 22 and/or bulkhead 23 may include a closeable and sealable access port (e.g., man hole cover) that allows controlled access to one or more chambers 26, 27 for maintenance, repair, and/or service.

Referring still to FIGS. 1 and 4, unlike sealed buoyant chamber 27, chamber 26 is ballast adjustable. In this embodiment, a ballast control system 80 and a port 81 enable adjustment of the relative volumes of gas 16 and variable ballast 18 in chamber 26. More specifically, port 81 is an opening or hole in section 21*a* of tubular 21 proximal bulkhead 23. When structure 10 is installed offshore, chamber 26 is submerged in the water 11, and thus, port 81 allows water 11, 18 to move into and out of chamber 26. In this embodiment, flow through port 81 is not controlled by a valve or other flow control device, and thus, port 81 permits the free flow of water 11, 18 into and out of chamber 26. However, in other embodiments, flow through port 81 may be controlled with a valve configured to open at a predetermined pressure differential across the valve—the pressure differential between water 18 in chamber 26 adjacent the port 81 and water 11 outside module 20 and adjacent port 81. In general, any suitable bi-directional check valve known in the art may be employed to control the bi-directional flow of fluids (e.g., water 11, 18 or air 16) through port 81. Such a valve is preferably configured to allow bi-directional flow at a relatively small pressure differential between about 5 and 300 psi, and more preferably between 50 and 150 psi. Inclusion of such a valve in port 81 restricts and/or prevents circulation of water 11, 18 into and out of chamber 26 through port 81 when there is an insufficient pressure differential across port 81, thereby offering the potential to reduce and/or eliminate the loss of air 16 from chamber 26 that may dissolve into water 11, 18 in chamber 26 over time and then circulate out of chamber 26 along with the water 11, 18 into which it is dissolved. Typically, absorption of air 16 into water 11, 18 within chamber 26 is minimal, however, over very long extended periods of time, the quantity of air 16 that may be absorbed into water 11, 18 within chamber 26 and then lost through circulation out of chamber 26 may be substantial.

Ballast control system 80 includes an air conduit 82, an air supply line 83, an air compressor or pump 84 connected to supply line 83, a first valve 85 along line 83 and a second valve 86 along conduit 82. Conduit 82 extends subsea into chamber 26, and has a venting end 82*a* above the sea surface 13 external chamber 26 and an open end 82*b* disposed within chamber 26 proximal upper cap 22. Valve 86 controls the flow of air 16 through conduit 82 between ends 82*a, b*, and valve 85 controls the flow of air 16 from compressor 84 to chamber 26. Control system 80 allows the relative volumes of air 16 and water 11, 18 in chamber 26 to be controlled and varied, thereby enabling the buoyancy of chamber 26 and associated module 20 to be controlled and varied. In particular, with valve 86 open and valve 85 closed, air 16 is exhausted from chamber 26, and with valve 85 open and valve 86 closed, air 16 is pumped from compressor 84 into chamber 26. Thus, end 82*a* functions as an air outlet, whereas end 82*b* functions as both an air inlet and outlet. With valve 85 closed, air 16 cannot be pumped into chamber 26, and with valves 85, 86 closed, air 16 cannot be exhausted from chamber 26.

In this embodiment, open end 82*b* is disposed proximal the upper end of chamber 26 and port 81 is positioned proximal the lower end of chamber 26. This positioning of open end 82*b* enables air 16 to be exhausted from chamber 26 when column is in a generally vertical, upright position (e.g., following installation). In particular, since buoyancy control air 16 (e.g., air) is less dense than water 11, any buoyancy control air 16 in chamber 26 will naturally rise to the upper portion of chamber 26 above any water 11, 18 in chamber 26 when module 20 is upright. Accordingly, positioning end 82*b* at or proximal the upper end of chamber 26 allows direct access to any air 16 therein. Further, since water 11, 18 in chamber 26 will be disposed below any air 16 therein, positioning port 81 proximal the lower end of chamber 26 allows ingress and egress of water 11, 18, while limiting and/or preventing the loss of any air 16 through port 81. In general, air 16 will only exit chamber 26 through port 81 when chamber 26 is filled with air 16 from the upper end of chamber 26 to port 81. Positioning of port 81 proximal the lower end of chamber 26 also enables a sufficient volume of air 16 to be pumped into chamber 26. In particular, as the volume of air 16 in chamber 26 is increased, the interface between water 11, 18 and the air 16 will move downward within chamber 26 as the increased volume of air 16 in chamber 26 displaces water 11, 18 in chamber 26, which is allowed to exit chamber through port 81. However, once the interface of water 11, 18 and the air 16 reaches port 81, the volume of air 16 in chamber 26 cannot be increased further as any additional air 16 will simply exit chamber 26 through port 81. Thus, the closer port 81 to the lower end of chamber 26, the greater the volume of air 16 that can be pumped into chamber 26, and the further port 81 from the lower end of chamber 26, the lesser the volume of air 16 that can be pumped into chamber 26. Thus, the axial position of port 81 along chamber 26 is preferably selected to enable the maximum desired buoyancy for chamber 26.

In this embodiment, conduit 82 extends radially through tubular 21. However, in general, the conduit (e.g., conduit 82) may extend through other portions of the module (e.g., module 20). For example, the conduit may extend axially through the module (e.g., through cap 22 at upper end 20*a* or bulkhead 23) in route to the ballast adjustable chamber (e.g., chamber 26). Any passages extending through a bulkhead or cap are preferably completely sealed.

It should be appreciated that air 16 will automatically vent from chamber 26 when ends 82*a, b* are in fluid communication. In particular, the air 16 in chamber 26 is compressed due to the hydrostatic pressure of water 11, 18. End 82*b* is positioned at the surface 13 (i.e., at about 1 atmosphere of pressure). Thus, when end 82*b* is in fluid communication with compressed air 16 in chamber 26, the compressed air 16 will inherently flow from the high pressure region (chamber 26) to the lower pressure region (end 82*b*), thereby allowing water 11, 18 to flood chamber 26 through port 81.

Without being limited by this or any particular theory, the flow of water 11, 18 through port 81 will depend on the depth of chamber 26 and associated hydrostatic pressure of water 11 at that depth, and the pressure of air 16 in chamber 26 (if any). If the pressure of air 16 is less than the pressure of water 11, 18 in chamber 26, then the air 16 will be compressed and additional water 11, 18 will flow into chamber 26 through port 81. However, if the pressure of air 16 in chamber 26 is greater than the pressure of water 11, 18 in chamber 26, then the air 16 will expand and push water 11, 18 out of chamber 26 through port 81. Thus, air 16 within chamber 26 will compress and expand based on any pressure differential between the air 16 and water 11, 18 in chamber 26.

In this embodiment, conduit 82 has been described as supplying air 16 to chamber 26 and venting air 16 from chamber 26. However, if conduit 82 is exclusively filled with air 16 at all times, a subsea crack or puncture in conduit 82 may result in the compressed air 16 in chamber 26 uncontrollably venting through the crack or puncture in conduit 82, thereby decreasing the buoyancy of upper module 20 and potentially impacting the overall stability of structure 10. Consequently, when air 16 is not intentionally being pumped into chamber 26 or vented from chamber 26 through valve 86 and end 82*b*, conduit 82 is preferably filled with water up to end 82*b*. The column of water in conduit 82 is pressure balanced with the compressed air 16 in chamber 16. Without being limited by this or any particular theory, the hydrostatic pressure of the column of water in conduit 82 will be the same or substantially the same as the hydrostatic pressure of water 11, 18 at port 81 and in chamber 26. As previously described, the hydrostatic pressure of water 11, 18 in chamber 26 is balanced by the pressure of air 16 in chamber 26. Thus, the hydrostatic pressure of the column of water in conduit 82 is also balanced by the pressure of air 16 in chamber 26. If the pressure of air 16 in chamber 26 is less than the hydrostatic pressure of the water in conduit 82, and hence, less than the hydrostatic pressure of water 11 at port 81, then the air 16 will be compressed, the height of the column of water in conduit 82 lengthen, and water 11 will flow into chamber 26 through port 81. However, if the pressure of air 16 in chamber 26 is greater than the hydrostatic pressure of the water in conduit 82, and hence, greater than the hydrostatic pressure of water 11 at port 81, then the air 16 will expand and push water 11, 18 out of chamber 26 through port 81 and push the column of water in conduit 82 upward. Thus, when water is in conduit 82, it functions similar to a U-tube manometer. In addition, the hydrostatic pressure of the column of water in conduit 82 is the same or substantially the same as the water 11 surrounding conduit 82 at a given depth. Thus, a crack or puncture in conduit 82 placing the water within conduit 82 in fluid communication with water 11 outside conduit 82 will not result in a net influx or outflux of water within conduit 82, and thus, will not upset the height of the column of water in conduit 82. Since the height of the water column in conduit 82 will remain the same, even in the event of a subsea crack or puncture in conduit 82, the balance of the hydrostatic pressure of the water column in conduit 82 with the air 16 in chamber 26 is maintained, thereby restricting and/or preventing the air 16 in chamber 26 from venting through conduit 82. To remove the water from conduit 82 to controllably supply air 16 to chamber 26 or vent air 16 from chamber 26 via conduit 82, the water in conduit 82 may simply be blown out into chamber 26 by pumping air 16 down conduit 82 via pump 84, or alternatively, a water pump may be used to pump the water out of conduit 82.

Figure 5:
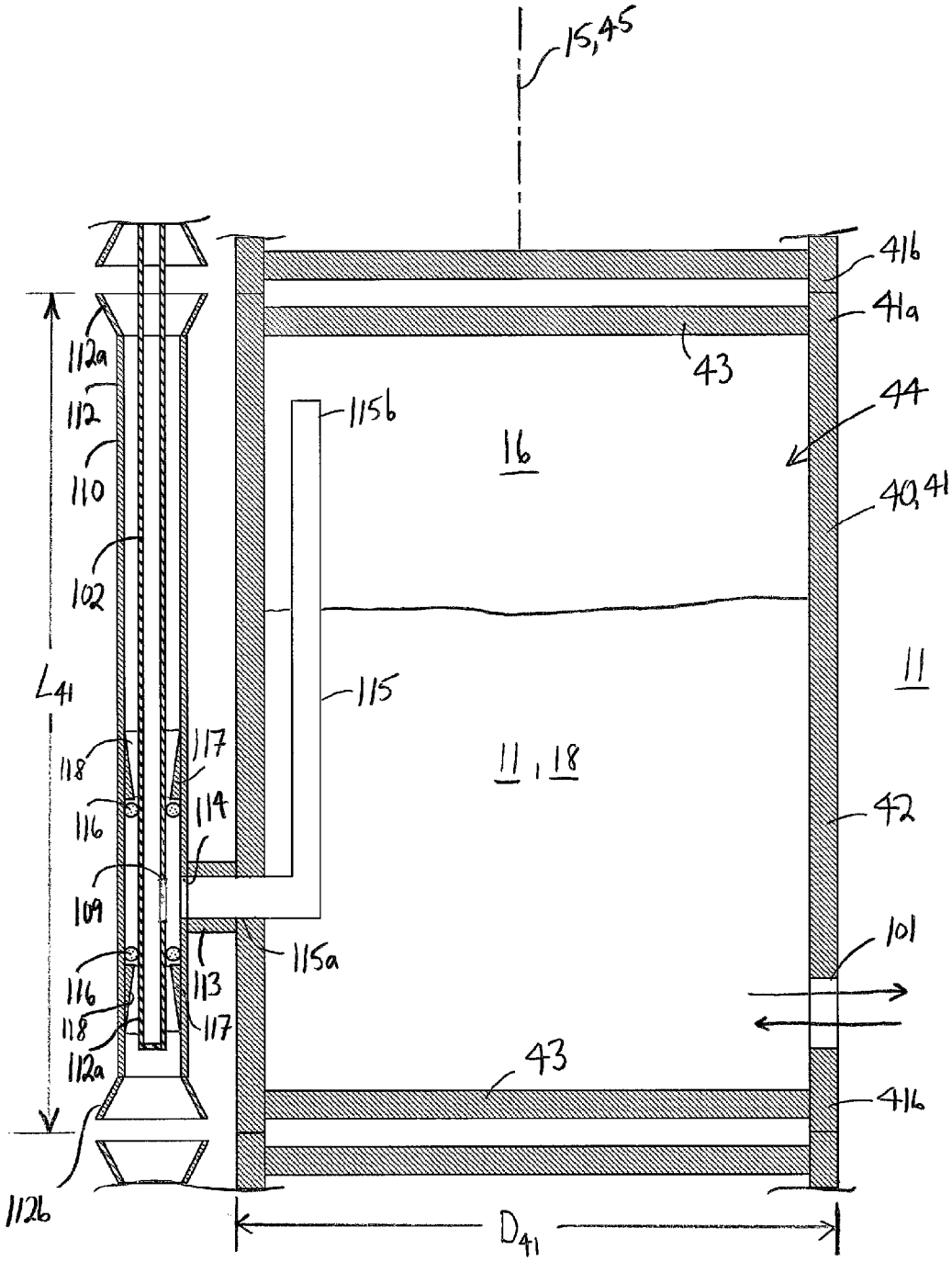
FIG. 5 is a schematic cross-sectional view of one of the stem modules of the offshore structure of FIG. 1.

Referring now to FIGS. 1 and 5, one exemplary module 41 is shown it being understood that each module 41 is configured the same. As previously discussed, module 41 has a central axis 45 coaxially aligned with axis 15, a first or upper end 41*a*, and a second or lower end 41*b* opposite end 41*a*. In addition, module 41 comprises a radially outer cylindrical tubular 42 extending axially between ends 41*a, b*, and an end wall or cap 43 at each end 41*a, b*. Caps 43 close off and seal module 41 at each end 41*a, b*. End caps 43 are each oriented perpendicular to axis 45. Together, tubular 42 and end walls 43 define a variable ballast chamber 44 within module 41. End caps 43 close off ends 41*a, b* of module 41, thereby preventing fluid flow through ends 41*a, b* into chamber 44. Thus, each chamber 44 is isolated from the other chambers 26, 27, 44 in structure 10.

Module 41 has a length $L_{41}$ measured axially between ends 41*a, b*, and a diameter $D_{41}$ that is less than $D_{21a}$. For an exemplary structure 10 deployed in 2,000 ft. of water and having a length $L_{10}$ of 2,000 ft., upper module 20 has a length $L_{20}$ of 250 ft., and stem 40 is comprised of twenty modules 41, each module 41 having a length $L_{41}$ of 87.5 ft. and a diameter $D_{41}$ of 6 to 10 ft. However, depending on the particular installation location and desired dynamics for structure 10, the number of modules 41, length $L_{41}$ and diameter $D_{41}$ of each module 41 may be varied and adjusted as appropriate. Although this example is designed for deployment in 2,000 ft. of water, in general, structure 10 may be lengthened for deployment in greater depths of water (e.g., 5,000 ft.) depending on environmental conditions and the load of deck 60.

During offshore transport of modules 41, variable ballast chambers 44 are filled with air 16, thereby contributing to the buoyancy of each module 41. However, during installation of stem 40 and operation of structure 10, ballast 18 may be controllably added to any one or more ballast adjustable chambers 44 to decrease the buoyancy of the corresponding module 41, stem 40, and structure 10.

Referring still to FIGS. 1 and 5, a ballast control system 100 and a port 101 in each module 41 enable adjustment of the volume of variable ballast 18 in select chambers 44. More specifically, port 101 is an opening or hole in each tubular 42 proximal its lower end 41*b*. When structure 10 is installed offshore, modules 41 are submerged in the water 11, and thus, ports 81 allow water 11, 18 to move into and out of chambers 44. In this embodiment, flow through ports 101 is not controlled by a valve or other flow control device, and thus, ports 101 permits the free flow of water 11, 18 into and out of chambers 44. However, in other embodiments, each port 101 may include a valve configured to open at a predetermined pressure differential across the valve—the pressure differential between water 18 in the chamber 44 adjacent the port 101 and water 11 outside the module 41 and adjacent port 101. In general, any suitable bi-directional check valve known in the art may be employed to control the bi-directional flow of fluids (e.g., water 11, 18 or air 16) through port 101. Such a valve is preferably configured to allow bi-directional flow at a relatively small pressure differential between about 5 and 300 psi, and more preferably between 50 and 150 psi. Inclusion of such a valve in each port 101 restricts and/or prevents circulation of water 11, 18 into and out of each chamber 44 through the corresponding port 101 when there is an insufficient pressure differential across that port 101. This offers the potential to reduce and/or eliminate the loss of air 16 from chamber 44 that may dissolve into water 11, 18 in chamber 44 over time and then circulate out of chamber 44 along with the water 11, 18 into which it is dissolved.

Ballast control system 100 includes an air conduit 102 mounted on a reel 103, an air line 104 extending from reel 103, an air compressor or pump 105 coupled to line 103 with an air supply conduit 106, a first valve 107 along line 104, and a second valve 108 along conduit 106. Line 104 is in fluid communication with conduit 102 and has an open or venting end 104*b*. Valve 107 controls the flow of air 16 between conduit 102 and end 104*b*, and valve 108 controls the flow of air 16 from compressor 104 through lines 106, 104 into conduit 102. Conduit 102 extends subsea from reel 103 along structure 10 and has an opening or port 109 proximal its lower or subsea end 102*a*. In this embodiment, conduit 102 is a semi-rigid hose or line capable of being bowed or flexed while simultaneously withstanding compressional and tensile loads such as coiled tubing. Conduit 102 is moveably coupled to modules 41 with conduit coupling members 110. In other embodiments where the conduit (e.g., conduit 102) does not need to flex or bend, the conduit may be a pipe string comprising a plurality of rigid pipe joints. One conduit coupling member 110 extends radially from each module 41, guides conduit 102 as it moves up and down along structure 10, and enables conduit 102 to provide gas to chambers 44.

Referring now to FIG. 5, one exemplary conduit coupling member 110 is shown it being understood that each coupling member 110 is configured the same. Coupling member 110 includes a guide tubular 112 secured to module tubular 42 and a connection conduit 113 extending radially between guide tubular 112 and module tubular 42. Guide tubular 112 extends substantially the entire axial length $L_{41}$ of module 41. In other words, guide tubular 112 extends from a first or upper end 112*a* at or proximal upper end 41*a* to a second or lower end 112*b* at or proximal lower end 41*a*. Ends 112*a, b* are flared (i.e., have an enlarged inner diameter) to help guide conduit 102 into and through tubular 112 as it us pushed or pulled therethrough. Further, guide tubular 112 includes a port 114 disposed between ends 112*a, b* and in fluid communication with connection conduit 113. Connection conduit 113 provides a flow path between guide tubular port 114 and a gas line 115 that extends through tubular 42 into chamber 44. Gas line 115 has a first end 115*a* coupled to conduit 113 and a second end 115*b* disposed within the upper portion of chamber 44.

A pair of annular seals 116 extend radially inward from guide tubular 112 on opposite sides of port 114—one seal 116 is positioned above port 114 and the other seal 116 is positions below port 114. Seals 116 sealingly engage tubular 112, and sealingly engage conduit 102 as it extends through guide tubular 112. In particular, seals 116 form an annular static seal with tubular 112 and an annular dynamic seal with conduit 102. To ensure conduit 102 is centered in tubular 112 within annular seals 116 as conduit 102 moves through tubular 112, a pair annular ramps 117 having a frustoconical guide or camming surface 118 is disposed within tubular 112 on opposite sides of seals 116—one ramp 117 is positioned axially adjacent and above the upper seal 116 and the other ramp 117 is positioned axially adjacent and below the lower seal 116.

Port 109 in conduit 102 may be positioned within tubular 112 to place conduit 102 in fluid communication with chamber 44 via port 114, conduit 113, and line 115. In particular, conduit 102 is axially advanced through or retracted from tubular 112 to axially position conduit port 109 between annular seals 116, thereby placing conduit 102 in fluid communication with chamber 44 via port 114, conduit 113, and line 115.

Control system 100 allows the relative volumes of air 16 and water 11, 18 in chamber 44 to be controlled and varied, thereby enabling the buoyancy of chamber 44 and associated module 41 to be adjusted. In particular, with valve 107 open and valve 108 closed, air 16 may be vented from chamber 44, thereby allowing water 11, 18 to flow into chamber 44 via port 101 (i.e., decreasing the volume of air 16 and increasing the volume of water 11, 18 in chamber 44); and with valve 108 open and valve 107 closed, air 16 may be pumped from compressor 105 into chamber 44, thereby forcing air 16 into chamber 44 and pushing water 11, 18 out of chamber 44 via port 101 (i.e., increasing the volume of air 16 and decreasing the volume of water 11, 18 in chamber 44). Thus, end 104*b* functions as an air outlet, whereas end 115*b* functions as both an air inlet and outlet. With valve 108 closed, air 16 cannot be pumped into chamber 44, and with valves 107, 108 closed, air 16 cannot be vented from chamber 44.

In this embodiment, open end 115*b* is disposed proximal the upper end of chamber 44 and port 101 is positioned proximal the lower end of chamber 44. This positioning of open end 115*b* enables air 16 to be vented from chamber 44 when column is in a generally vertical, upright position. In particular, since buoyancy control gas 16 (e.g., air) is less dense than water 11, 18, any air 16 in chamber 44 will naturally rise to the upper portion of chamber 44 above any water 11, 18 in chamber 44 when module 41 is generally upright. Accordingly, positioning end 115*b* at or proximal the upper end of chamber 44 allows direct access to any air 16 therein. Further, since water 11, 18 in chamber 44 will be disposed below any air 16 therein, positioning port 101 proximal the lower end of chamber 44 allows ingress and egress of water 11, 18, while limiting and/or preventing the loss of any air 16 through port 101. In general, air 16 will only exit chamber 44 through port 101 when chamber 44 is filled with air 16 from the upper end of chamber 44 to port 101. Positioning of port 101 proximal the lower end of chamber 44 also enables a sufficient volume of air 16 to be pumped into chamber 26. In particular, as the volume of air 16 in chamber 44 is increased, the interface between water 11, 18 and the air 16 will move downward within chamber 44 as the increased volume of air 16 in chamber 44 displaces water 11, 18 in chamber 26, which is allowed to exit chamber through port 101. However, once the interface of water 11, 18 and the air 16 reaches port 101, the volume of air 16 in chamber 44 cannot be increased further as any additional air 16 pumped into chamber 44 will simply exit chamber 44 through port 101. Thus, the closer port 101 to the lower end of chamber 44, the greater the maximum volume of air 16 that can be pumped into chamber 44, and the further port 101 from the lower end of chamber 44, the lower the maximum volume of air 16 that can be pumped into chamber 44. Thus, the axial position of port 101 along chamber 44 is preferably selected to achieve the desired maximum volume of air 16 in chamber 44 and associated buoyancy of chamber 44.

In this embodiment, flowline 115 extends radially through tubular 42. However, in general, the flowing extending into the chamber (e.g., flowline 115) may extend through other portions of the module (e.g., module 41). For example, the flowline may extend axially through the module (e.g., through cap 43 at upper end 41*a*) in route to the ballast adjustable chamber (e.g., chamber 44). Any passages extending through a bulkhead or cap are preferably completely sealed.

Without being limited by this or any particular theory, the flow of water 11, 18 through port 101 will depend on the depth of chamber 44 and associated hydrostatic pressure of water 11 at that depth, and the pressure of air 16 in chamber 44 (if any). If the pressure of air 16 is less than the pressure of water 11, 18 in chamber 44, then the air 16 will be compressed and additional water 11, 18 will flow into chamber 44 through port 101. However, if the pressure of air 16 in chamber 44 is greater than the pressure of water 11, 18 in chamber 44, then the air 16 will expand and push water 11, 18 out of chamber 44 through port 101. Thus, air 16 within chamber 26 will compress and expand based on any pressure differential between the air 16 and water 11, 18 in chamber 44.

It should be appreciated that air 16 will automatically vent from chamber 44 when ends 104*b*, 115*b* are in fluid communication. In particular, the air 16 in chamber 44 is compressed due to the hydrostatic pressure of water 11, 18 in chamber 44. End 104*b* is positioned at the surface 13 (i.e., at about 1 atmosphere of pressure). Thus, when end 104*b* is in fluid communication with compressed air 16 in chamber 44, the compressed air 16 will inherently flow from the high pressure region (chamber 44) to the lower pressure region (end 104*b*), thereby allowing water 11, 18 to flood chamber 44 through port 101.

Figure 6:
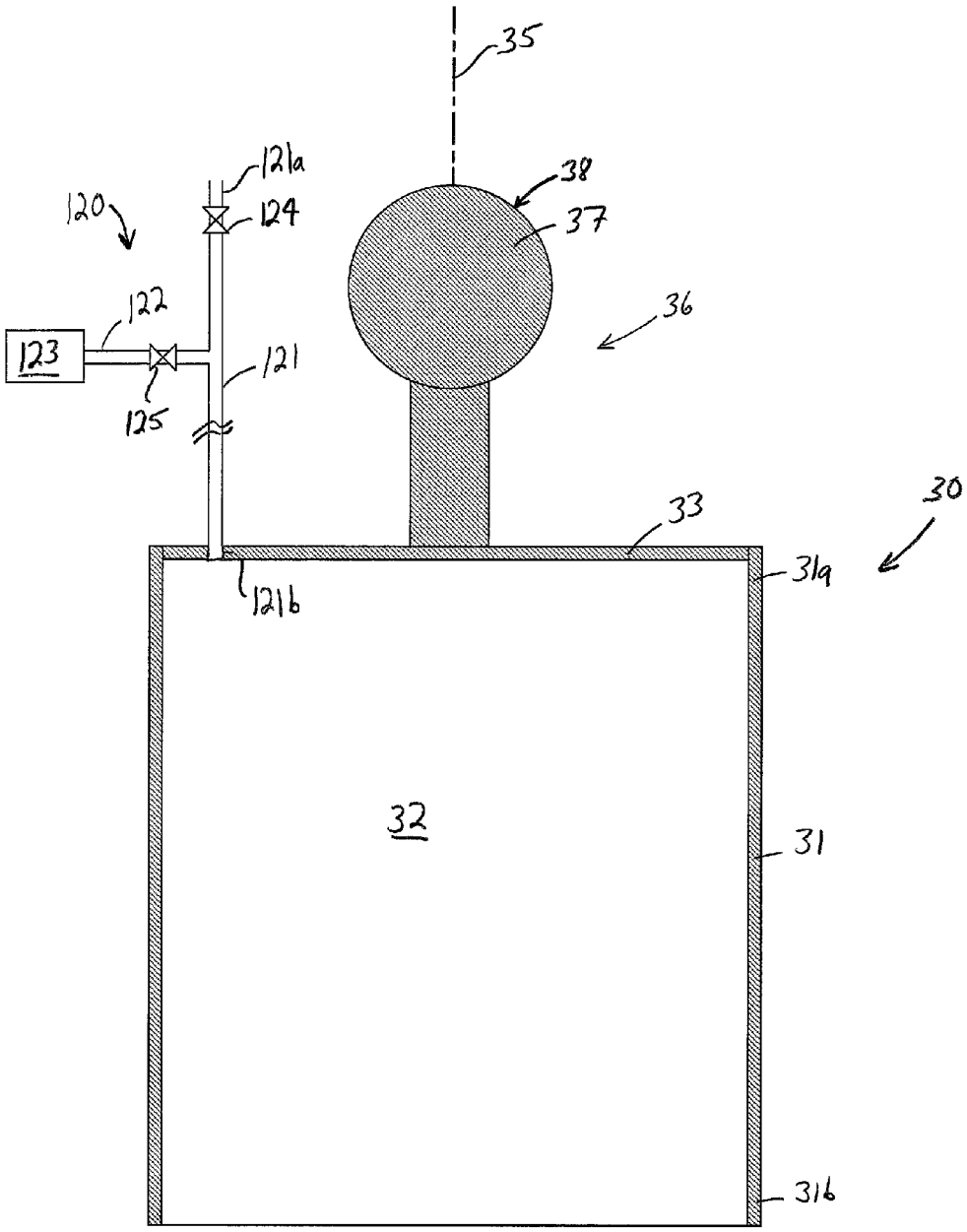
FIG. 6 is a schematic cross-sectional view of the anchor of the offshore structure of FIG. 1.

Although only one module 41 and associated chamber 44 is shown and described in FIG. 6, each module 41 and associated chamber 44 is ballasted and deballasted in the same manner. In particular, conduit 102 is moved axially up and down along stem 40 and through coupling members 110 to position port 109 in fluid communication with the particular chamber 44 to be ballasted or deballasted. In this manner, the buoyancy of each module 41 may be independently controlled and varied. Further, since upper module 20 includes its own dedicated ballast control system 80, the buoyancy of upper module 20 may be adjusted independent of modules 41. Thus, in the event of a leak in any module 20, 41 the buoyancy of other modules 20, 41 may be adjusted to maintain the overall desired buoyancy of structure 10.

As conduit 102 is moved axially along stem 40, it may be completely removed from select coupling members 110, thereby placing the corresponding flowline 115 in fluid communication with the surrounding environment via conduit 113, port 114, and tubular 112. However, for a given module 41, port 114, conduit 113 and end 115*a* are disposed at the same axial position as port 101 (at or proximal lower end 41*b*), and thus, the hydrostatic pressure of water 11 at ports 101, 114 is the same. Since the air 16 in chamber 44 is compressed to the hydrostatic pressure of water 11 at port 101, it is also compressed to the hydrostatic pressure of water 11 at port 114. Therefore, the relative volumes of air 16 and water 11, 18 within a given chamber 44 will remain the same or substantially the same when conduit 102 is completely removed from the corresponding coupling member 110.

As best shown in FIGS. 1, 2, and 4, in this embodiment, section 21*a* of module 20 is cylindrical, section 21*b* of module 20 is frustoconical, and each module 41 is cylindrical. However, in general, modules 20, 41 may have any suitable geometry. Further, the size of each module 20, 50 and offshore structure 10 will depend, at least in part, on the depth of water and the desired amount of buoyancy. For example, each module 20, 41 may have any suitable axial length and diameter. However, without being limited by this or any particular theory, as the module length decreases, the module design pressure requirements decrease (i.e., the maximum pressure differential the module must be designed to withstand decreases). Thus, to reduce the module design pressure requirements, the module diameter or width may be increased and the module length or height may be decreased.

Although a single ballast control system 100 and conduit 102 are employed to selectively control and adjust the relative volumes of air 16 and water 11, 18 in each chamber 44 in this embodiment, in other embodiments, each chamber 44 may have its own dedicated ballast control system. For example, each chamber 44 may have a ballast control system configured the same as ballast control system 80 previously described. As another example, conduit 102 may be completely eliminated and each chamber 44 may be selectively deballasted by injecting air using a subsea ROV.

Referring now to FIGS. 1, 2, and 6, structure 10 is releasably secured to the sea floor 12 with anchor 30. In this embodiment, anchor 30 is a suction pile comprising an annular, cylindrical skirt 31 having a central axis 35, a first or upper end 31*a* proximal stem 40, a second or lower end 31*b* distal stem 40, and a cylindrical cavity 32 extending axially between ends 31*a, b*. Cavity 32 is closed off at upper end 31*a* by cap 33, however, cavity 32 is completely open to the surrounding environment at lower end 31*b*.

As will be described in more detail below, during installation of structure 10, skirt 31 is urged axially downward into the sea floor 12, and during decoupling of structure 10 from the sea floor 12 for transport to a different offshore location, skirt 31 may pulled axially upward from the sea floor 12. To facilitate the insertion and removal of anchor 30 into and from the sea floor 12, this embodiment includes a suction/injection control system 120.

Referring now to FIG. 6, system 120 includes a main flowline or conduit 121, a fluid supply/suction line 122 extending from main conduit 121, and an injection/suction pump 123 connected to line 122. Conduit 121 extends subsea along the outside of structure 10 to cavity 32, and has an upper venting end 121*a* and a lower open end 121*b* in fluid communication with cavity 32. A valve 124 is disposed along conduit 121 controls the flow of fluid (e.g., mud, water, etc.) through conduit 121 between ends 121*a, b*—when valve 124 is open, fluid is free to flow through conduit 121 from cavity 32 to venting end 121*a*, and when valve 124 is closed, fluid is restricted and/or prevented from flowing through conduit 121 from cavity 32 to venting end 121*a*.

Pump 123 is configured to pump fluid (e.g., water 101) into cavity 32 and pump fluid (e.g., water 101, mud, silt, etc.) from cavity 32 via line 122 and conduit 121. A valve 125 is disposed along line 122 and controls the flow of fluid through line 122—when valve 125 is open, pump 123 may pump fluid into cavity 32 via line 122 and conduit 121, or pump fluid from cavity 32 via conduit 121 and line 122; and when valve 125 is closed, fluid communication between pump 123 and cavity 32 is restricted and/or prevented.

In this embodiment, pump 123, line 122, and valves 124, 125 are positioned axially above stem 40 and module 20, and may be accessed from deck 60. However, in general, the injection/suction pump (e.g., pump 123), the suction/supply line (e.g., line 122), and valves (e.g., valves 124, 125) may be disposed at any suitable location. For example, the pump and valves may be disposed subsea and/or remotely actuated.

Figure 7:
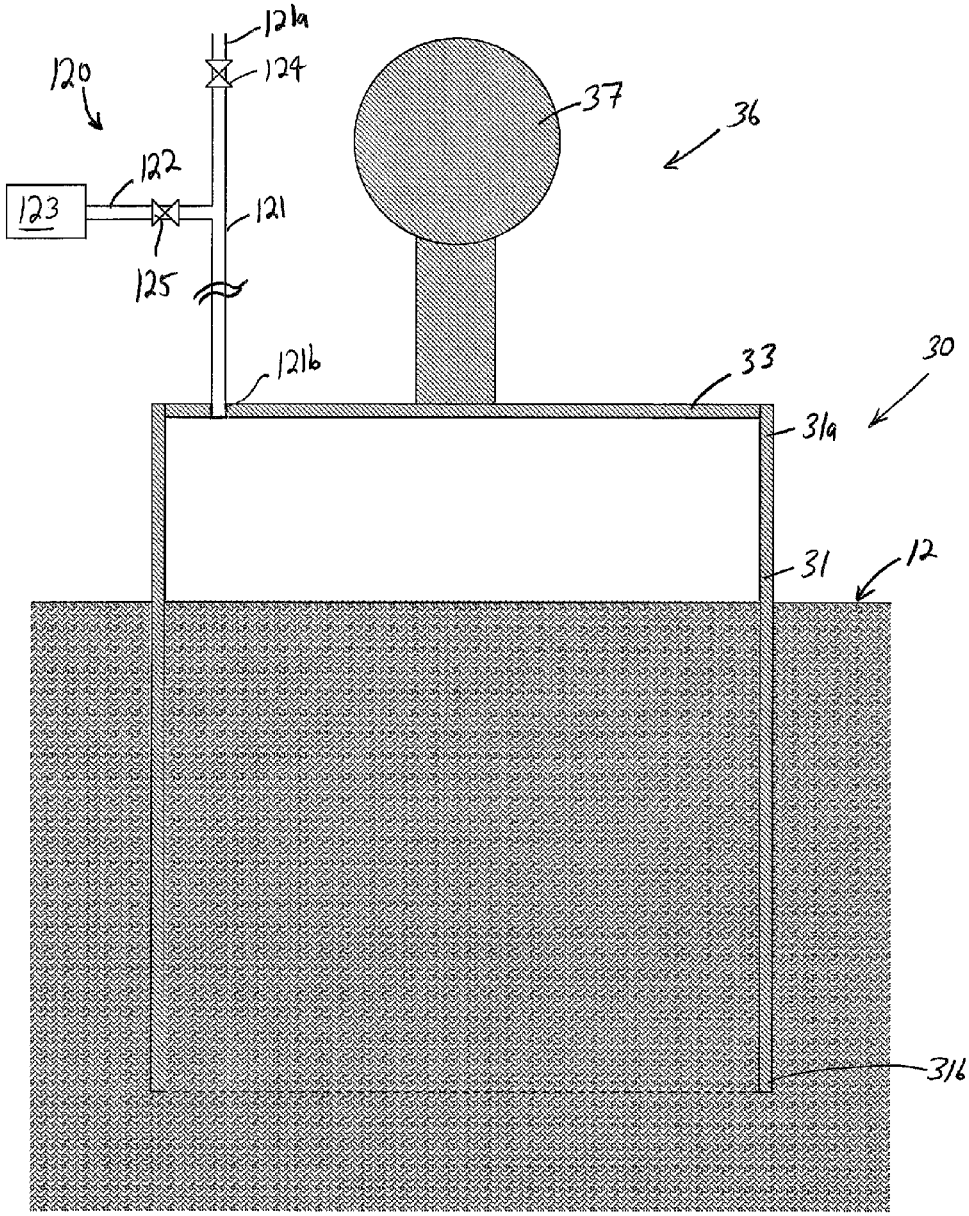
FIG. 7 is a schematic cross-sectional view of the anchor of FIG. 6 being urged into or pulled from the sea floor.

Referring now to FIG. 7, suction/injection control system 120 may be employed to facilitate the insertion and removal of anchor 30 into and from the sea floor 12. In particular, as skirt 31 is urged into sea floor 12, valve 124 may be opened and valve 125 closed to allow water 101 within cavity 32 between sea floor 12 and cap 33 to vent through conduit 121 and out end 121*a*. To accelerate the penetration of skirt 31 into sea floor 12 and/or to enhance the "grip" between suction skirt 31 and the sea floor 12, suction may be applied to cavity 32 via pump 123, conduit 121 and line 122. In particular, valve 125 may be opened and valve 124 closed to allow pump 123 to pull fluid (e.g., water, mud, silt, etc.) from cavity 32 through conduit 121 and line 122. Once skirt 31 has penetrated the sea floor 12 to the desired depth, valves 124, 125 are preferably closed to maintain the positive engagement and suction between anchor 30 and the sea floor 12.

To pull and remove anchor 30 from the sea floor 12 (e.g., to move tower 100 to a different location), valve 124 may be opened and valve 125 closed to vent cavity 32 and reduce the hydraulic lock between skirt 31 and the sea floor 12. Skirt 31 may also be removed from sea floor 12 by pumping fluid (e.g., water 11) into cavity 32 via pump 123, conduit 121 and line 122. In particular, valve 125 may be opened and valve 124 closed to allow pump 123 to inject fluid into cavity 32 through conduit 121 and line 122, thereby increasing the pressure in cavity 32 and urging anchor 30 upward and out of the sea floor 12.

As previously described, in this embodiment, anchor 30 is a suction pile. However, in other embodiments, the anchor (e.g., anchor 30) for coupling the productions structure (e.g., structure 10) to the sea floor may comprise other suitable anchoring devices or system including, without limitation, a driven pile or a gravity anchor. Any of the embodiments for releasably and pivotally coupling structure 10 to anchor 30 described below may be employed with such driven piles or gravity anchors.

Figure 8:
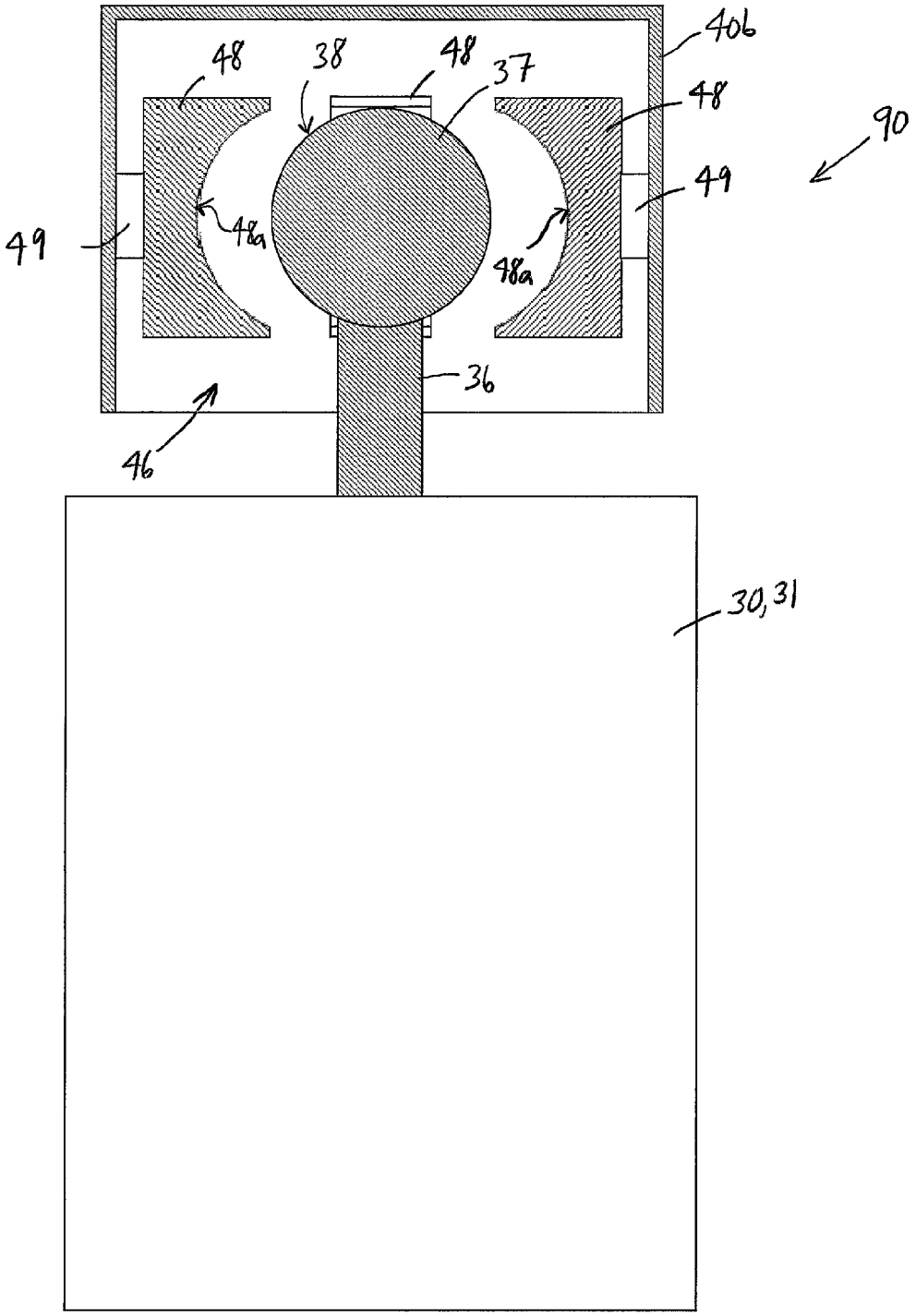
FIG. 8 is a schematic partial cross-sectional view of the coupling of FIG. 6 being received within the cavity in the lower end of the stem of FIG. 1.
Figure 9:
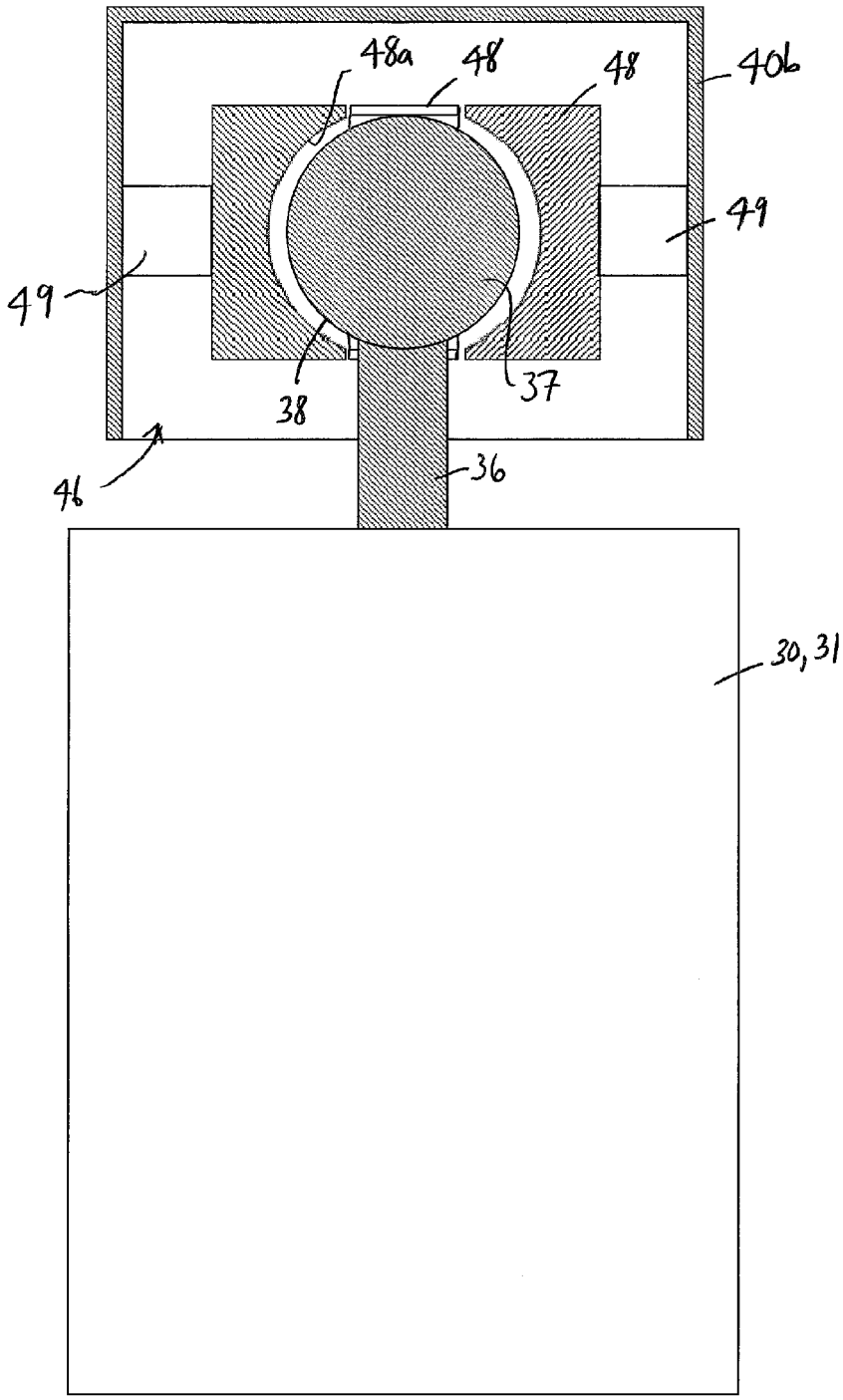
FIG. 9 is a schematic partial cross-sectional view of the coupling of FIG. 6 locked within the cavity in the lower end of the stem of FIG. 1.

Referring now to FIGS. 2 and 8, base 30 and stem 40 are coupled together with a pivotal and releasable coupling 90. In this embodiment, coupling 90 is a ball-and-socket type connection including a stabbing member 36 extending from the upper end of cap 33 that is received within a recess or cavity 46 in lower end 40*b*. In this embodiment, stabbing member 36 comprises a spherical ball 37 at its upper end that is received into cavity 46 and then releasably locked therein by a mating locking mechanism 47. In particular, locking mechanism 47 is disposed within cavity 46 and includes a plurality of circumferentially spaced locking blocks 48 and a plurality of circumferentially spaced actuators 49. In this embodiment, four uniformly circumferentially spaced locking blocks 48 are provided. At least one actuator 49 is coupled to each locking block 48 and is configured to transitions the corresponding locking block 48 between a radially withdrawn position within cavity 46 (FIG. 8) and a radially advanced position within cavity 46 (FIG. 9). In general, actuators 49 may comprise any suitable type of actuator including, without limitation, hydraulic actuators. Each locking block 48 has a concave surface 48*a* sized and configured to mate with and slidingly engage ball 37. Together, surfaces 48*a* of blocks 48 define a socket that receives ball 37. In this embodiment, ball 37 has a spherical outer surface 38, and thus, surfaces 48*a* are concave partial spherical surfaces disposed at a radius that is the same or slightly greater than the radius of ball 37.

To pivotally couple structure 10 and anchor 30, locking blocks 48 are radially withdrawn by actuators 49 as shown in FIG. 8. Next, ball 37 is axially advanced into cavity 46 and positioned between blocks 48 with ball 37 axially aligned with surfaces 48*a*. Moving now to FIG. 9, actuators 49 transition locking blocks 48 from the radially withdrawn position to the radially advanced position around ball 37, thereby capturing ball 37 between surfaces 48*a*. To maintain coupling of anchor 30 and structure 10, locking blocks 48 are maintained in the radially advanced position.

During offshore operations, systems 80, 100 are employed to adjust the ballast in chambers 26, 44 such that structure 10 remains generally vertical and upright. For example, structure 10 may be configured to be net buoyant (i.e., the total buoyancy of structure 10 exceeds the total weight of structure 10), thereby placing stem 40 and coupling 90 in tension. As another example, structure 10 may not be configured to be net buoyant (i.e., the total buoyancy of structure 10 is less than the total weight of structure 10), with upper module 20 and/or select upper modules 41 configured to be net buoyant to maintain the generally vertical upright orientation of structure 10. In such embodiments, an upper portion of stem 40 is in tension, whereas a lower portion of stem 40 and coupling 90 is in compression. Accordingly, embodiments of couplings between structure 10 and anchor 30 (e.g., coupling 90) are preferably configured to releasably and pivotally couple structure 10 under both tensile and compressional loads. Surfaces 48*a* of blocks 48 extending along an upper portion and lower portion of mating surface 38 of ball 37 enables coupling 90 to sustain compressional and tensile loads while simultaneously allowing structure 10 to pivot relative to anchor 30. Whether coupling 90 is in tension or compression, anchor 30 maintains engagement with the sea floor 12 and prevents structure 10 from moving translationally relative to anchor 30, while allowing structure 10 to pivot relative to base 30.

Since structure 10 is secured to the sea floor 12 and held in place relative to the sea floor 12 at a single point (via coupling 90), structure 10 may be described as a "single-moored" structure. Structure 10 may be released and decoupled from stabbing member 36 and anchor 30 by radially withdrawing locking blocks 48 with actuators 49, and then lifting or floating structure 10 upward thereby allowing ball 37 to exit cavity 46. Once decoupled from anchor 30, tower 10 may be floated to a different offshore site and installed at the new site with an anchor 30 in the same manner as previously described.

Figure 10A:
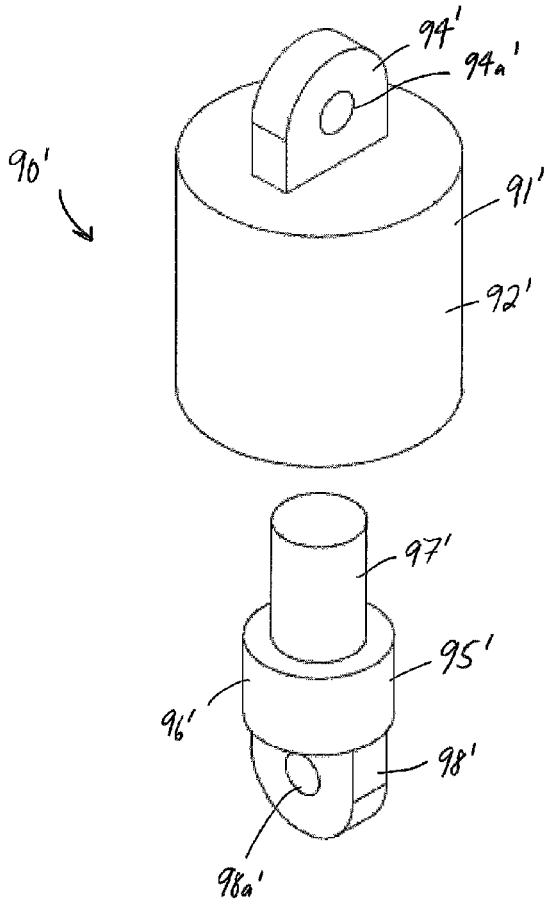
FIG. 10A is a perspective view of an embodiment of a coupling that may be employed to releasably and pivotally couple the offshore structure and anchor of FIG. 1.
Figure 10B:
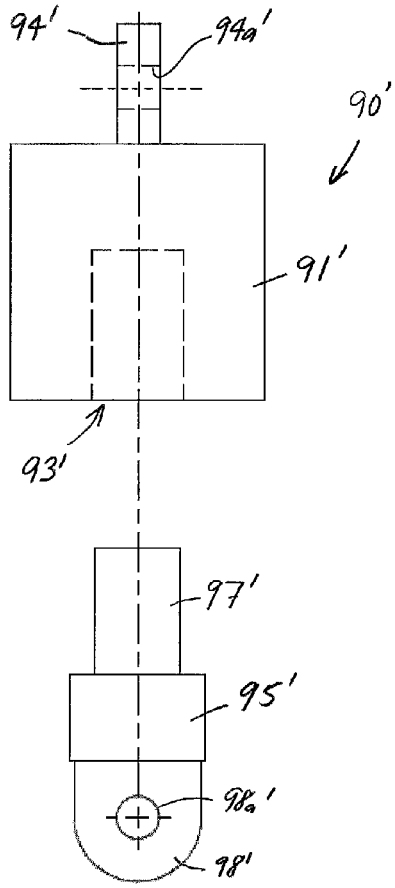
FIG. 10B is a side view of the coupling of FIG. 10.

FIG. 9 illustrates one exemplary type of a releasable, pivotable coupling 90 between anchor 30 and structure 10. However, other suitable types of pivotable couplings known in the art may also be employed. For example, in FIGS. 10A and 10B, an embodiment of a releasable, pivotable coupling 90' is shown. Coupling 90' is a universal joint including an upper member 91' releasably coupled to a lower member 95'. Upper member 91' has a body 92' with a receptacle 93' at its lower end and a pivotable hinge coupling 94' at its upper end. Coupling 94' is pivotally coupled to the lower end of stem 40 with a pin that is pass through an eye 94*a*' in coupling 94', thereby allowing structure 10 to pivot relative to upper member 91' in a first plane oriented perpendicular to the central axis of eye 94*a*'. Lower member 95' has a body 96' with a stabbing member 97' at its upper end and a pivotable hinge coupling 98' at its lower end. Lower member 95' is pivotally coupled to the upper end of anchor 30 with a pin that is pass through an eye 98*a*' in coupling 98', thereby allowing lower member 95' to pivot relative to anchor 30 in a second plane oriented perpendicular to the central axis of eye 98*a*'. Stabbing member 97' is received by receptacle 93' and releasably secured therein. In this embodiment, a J-slot connection known in the art is employed to releasably secure member 97' within receptacle 93'. The J-slot connection is preferably configured such that the first plane within which structure 10 is allowed to pivot relative to upper member 91' is oriented perpendicular to the second plane within which lower member 95' is allowed to pivot relative to anchor 30. Such a releasable J-slot connection is capable of withstanding both compressional and tensile loads.

Other examples of suitable pivotable couplings include, without limitation, stabbing connections, U-joints, gimbles, or chain or shackle systems known in the art. Such connections may be configured to be releasable by any means or mechanism known in the art including, without limitation, a J-slot connector, a ball grab, or other remotely actuated releasable connection. Moreover, pivotable and releasable couplings used in conjunction with subsea risers and tendons such as the SCR FlexJoint® Receptacle and Pull-In Connectors available from Oil States International, Inc. of Houston, Tex., FlexJoint® Tendon Bearing available from Oil States International, Inc. of Houston, or H-4 Subsea Connectors available from VetcoGray of Houston, Tex. may also be used in place of coupling 90 previously described.

Referring again to FIG. 1, deck 60 sits atop upper module 20. In general, deck 60 supports production-related equipment such as pumps, compressors, valves, etc. In this embodiment, upper module 20 extends above the sea surface 13, and thus, deck 60 is positioned above the sea surface 13. However, in other embodiments, the upper module (e.g., upper module 20) and/or the deck (e.g., deck 60) may be disposed generally proximal but below the sea surface.

Figure 11:
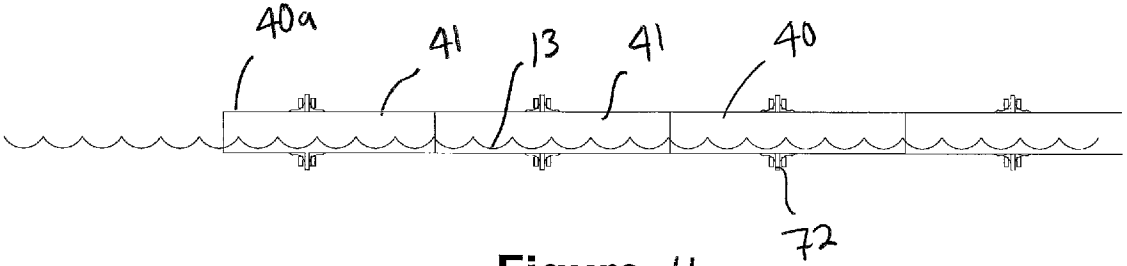
FIGS. 11-16 are sequential schematic views illustrating an embodiment of a method for assembling the offshore structure of FIG. 1.

Structure 10 may be assembled and installed at the desired offshore location in a variety of different manners. For example, structure 10 may be completely assembled on shore or nearshore, transported to the offshore installation site, and coupled to anchor 30. Another exemplary embodiment of a method for assembling and installing structure 10 is schematically illustrated in FIGS. 11-16. Referring first to FIG. 11, in this embodiment, modules 41 are coupled end-to-end onshore or nearshore to form stem 40, which is then transported to the offshore installation location. Modules 41 are preferably oriented and connected such that coupling members 110 on adjacent modules 41 are circumferentially aligned and riser guides 72 on adjacent modules 41 are circumferentially aligned. In addition, ballasting system 100 is preferably installed and transported offshore along with stem 40. Stem 40 may be free floated out to the offshore installation location in the horizontal orientation as shown in FIG. 11. For example, modules 41 may be completely or substantially filled with air 16 and ports 101 temporarily plugged and/or oriented above the sea surface 13 and conduit 102 extending through each coupling member 110 without port 109 in fluid communication with any flowlines 15, thereby preventing the ingress of water into chambers 44 and maintaining a positive net buoyancy for each module 41 and stem 40. Alternatively, stem 40 may be transported to the offshore installation location on a vessel (e.g., barge), and then offloaded from the vessel at the installation location (e.g., floated off the vessel by sufficiently ballasting the vessel or lifted off the vessel with a heavy lift device).

Figure 12:
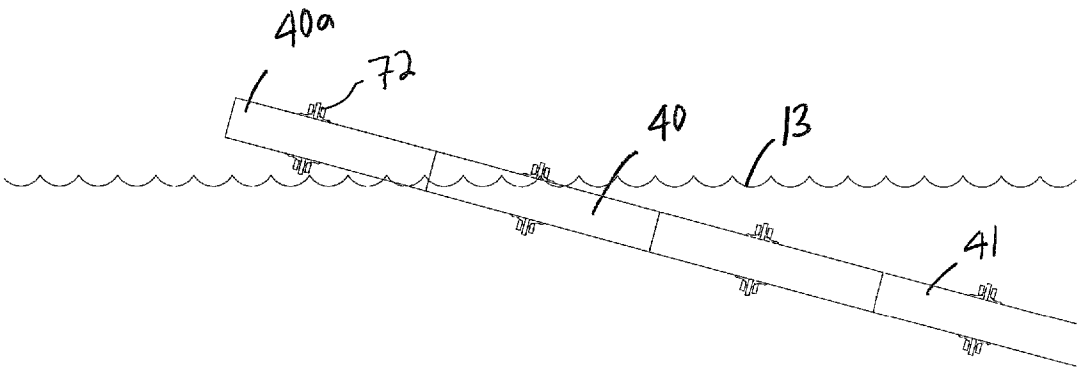
Figure 13:
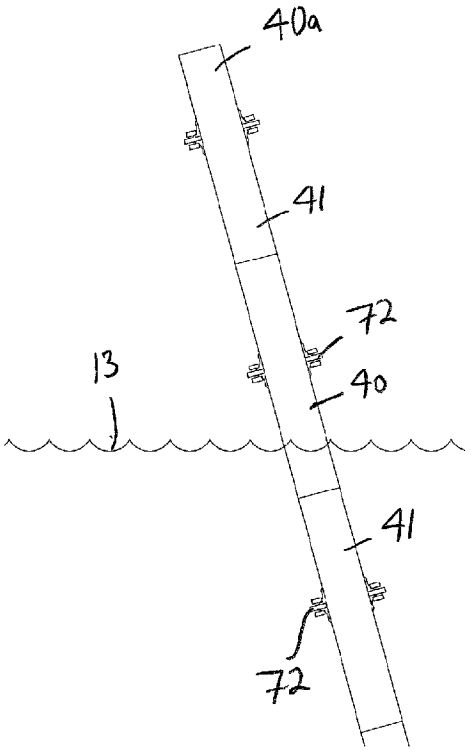
Figure 16:
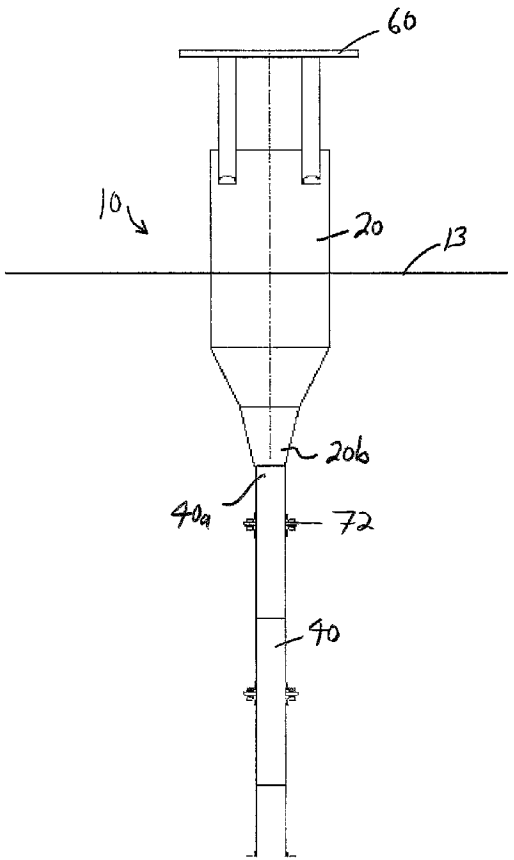

Moving now to FIGS. 12 and 13, at the desired offshore installation location, select modules 41 at or proximal end 40*b* are ballasted (e.g., with water) to tilt stem 40 into a generally vertical orientation. For example, the temporary plugs in ports 101 of one or more modules 41 proximal end 40*b* may be first removed to allow those particular modules 41 to at least partially flood with water and rotate downward, followed by removal of the remaining plugs. As stem 40 transitions to a more upright position, ballasting control system 100 may be employed to independently control the relative volumes of air 16 and water 11, 18 in each chamber 44.

Figure 14:
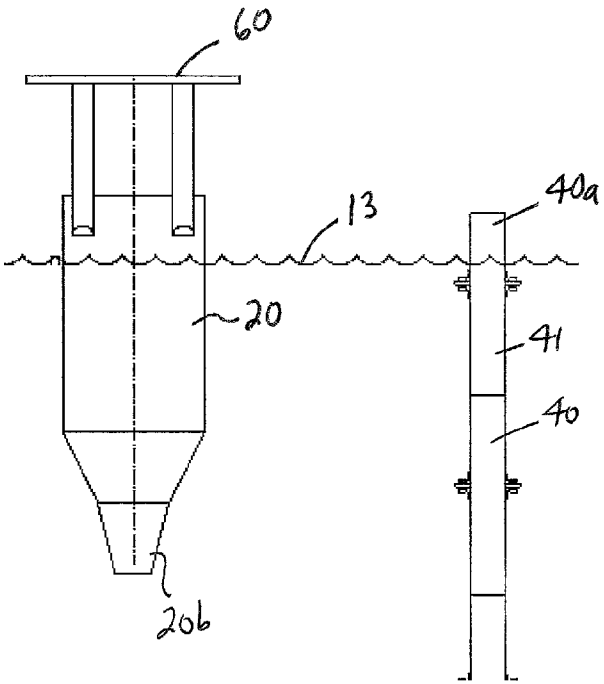

Referring now to FIG. 14, deck 60 is mounted to upper module 20 and ballasting system 80 is installed onshore or nearshore, and then the assembly is transported to the offshore installation site. Upper module 20, and deck 60 mounted thereto, may be free floated out to the offshore installation location in the vertical orientation as shown in FIG. 14. For example, chamber 26 may be partially filled with air 16. Port 81 need not be plugged during transport of upper module 20 in the vertical orientation as ballasting system 80 may be used during transport to adjust the relative volumes of air 16 and water 11, 18 in upper module 20. Alternatively, upper module 20, and deck 60 mounted thereto, may be transported to the offshore installation location on a vessel (e.g., barge), and then offloaded from the vessel at the installation location (e.g., floated off the vessel by sufficiently ballasting the vessel or lifted off the vessel with a heavy lift device). As still yet another alternative, deck 60 may be mounted to upper module 20 offshore (e.g., at the installation site) by ballasting upper module 20, positioning deck 60 across a pair of barges and moving deck 60 over upper module 20 with the barges, and then deballasting upper module 20 to lift deck 60 from the barges.

Figure 15:
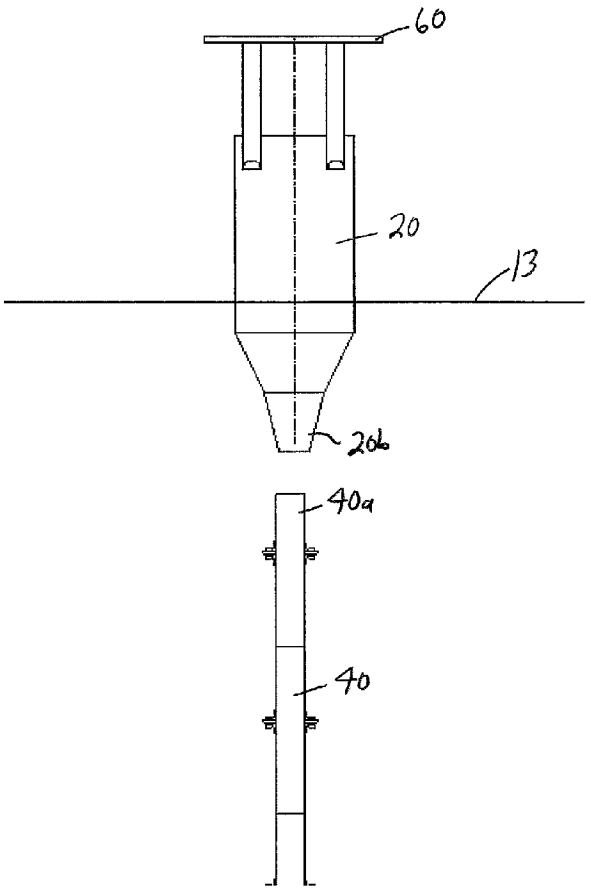

As shown in FIG. 15, with stem 40 and upper module 20 generally upright, the stem 40 is ballasted using system 100 and/or upper module 20 is deballasted using system 80 to position lower end 20*b* above upper end 40*a*. Moving now to FIG. 15, upper module 20 and/or stem 40 is moved laterally to coaxially align module 20 with stem 40, and then, upper module 20 is ballasted and/or stem 40 is deballasted to bring ends 20*b*, 40*a* into engagement. Upper module 20 may then be securely attached to stem 40 to form structure 10.

As previously described, anchor 30 secures structure 10 to the sea floor 12. In general, anchor 30 may be installed at the offshore installation site before, after, or during assembly of structure 10. Thus, anchor 30 may be lowered subsea and secured to the sea floor 12 followed by coupling of structure 10 to anchor 30. For example, anchor 30 may be installed in a similar manner as a conventional driven pile with the exception that system 120 may be employed as previously described to facilitate the insertion of suction skirt 31 into the sea floor 12. In embodiments where anchor 30 is installed in the sea floor 12 prior to coupling structure 10 to anchor 30, structure 10 may be moved laterally over anchor 30, ballasted to advance stabbing member 36 into cavity 46, and then transitioning locking blocks 48 to the radially advanced position, thereby capturing ball 37 within cavity 46. Alternatively, anchor 30 may be coupled to structure 10 and then secured to the sea floor 12 using structure 10. For example, anchor 30 may be coupled to lower end 40*b* of stem 40 and urged into the sea floor 12 by deballasting structure 10 and employing system 120 as previously described. With structure 10 coupled to anchor 30, and anchor 30 embedded in the sea floor 12, select chambers 26, 44 may be ballasted and/or deballasted to achieve the desired overall buoyancy and orientation of structure 10.

Although not shown in FIGS. 11-16, reel 103, air line 104, pump 105, and valves 107, 108 may be temporarily disposed on and operated from a vessel alongside stem 40 prior to installation of upper module 20 and deck 60. In addition, a lifting device or crane on a surface vessel and/or one or more subsea ROVs may be employed to facilitate the assembly and installation of structure 10. In general, risers 70 are coupled to structure 10 after installation.

Figure 17:
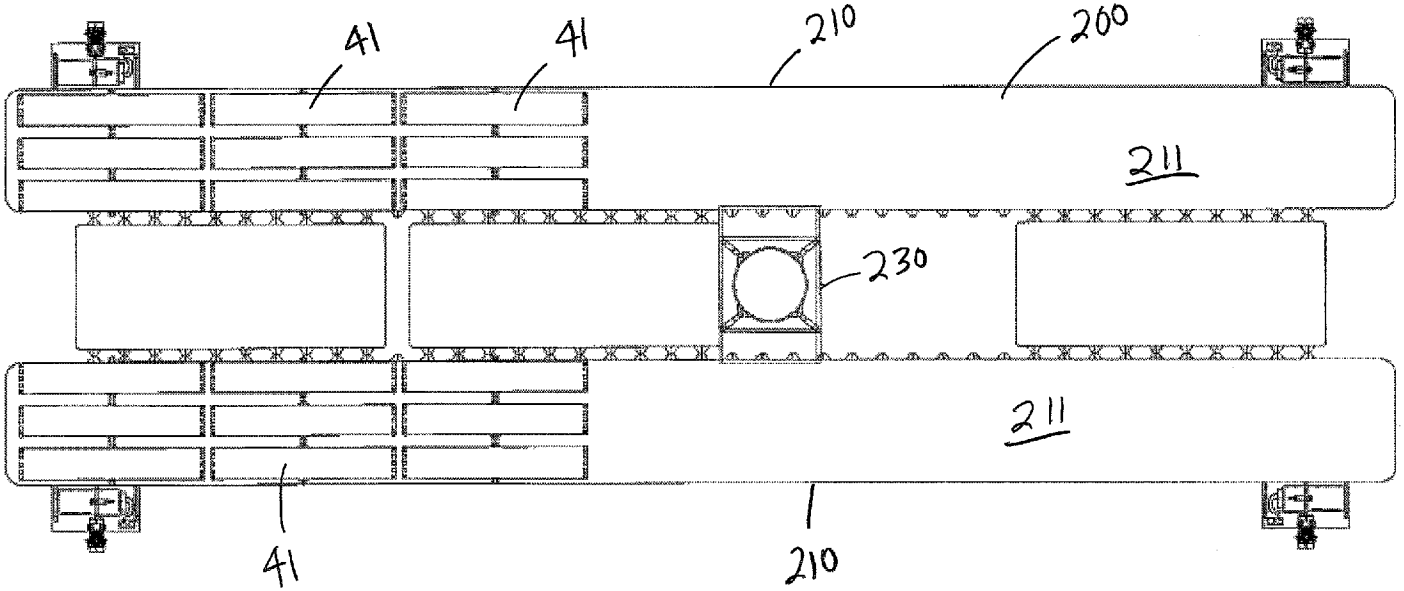
FIGS. 17-22 are sequential schematic views illustrating an embodiment of a method for coupling axially adjacent modules to assemble the offshore structure of FIG. 1.
Figure 18:
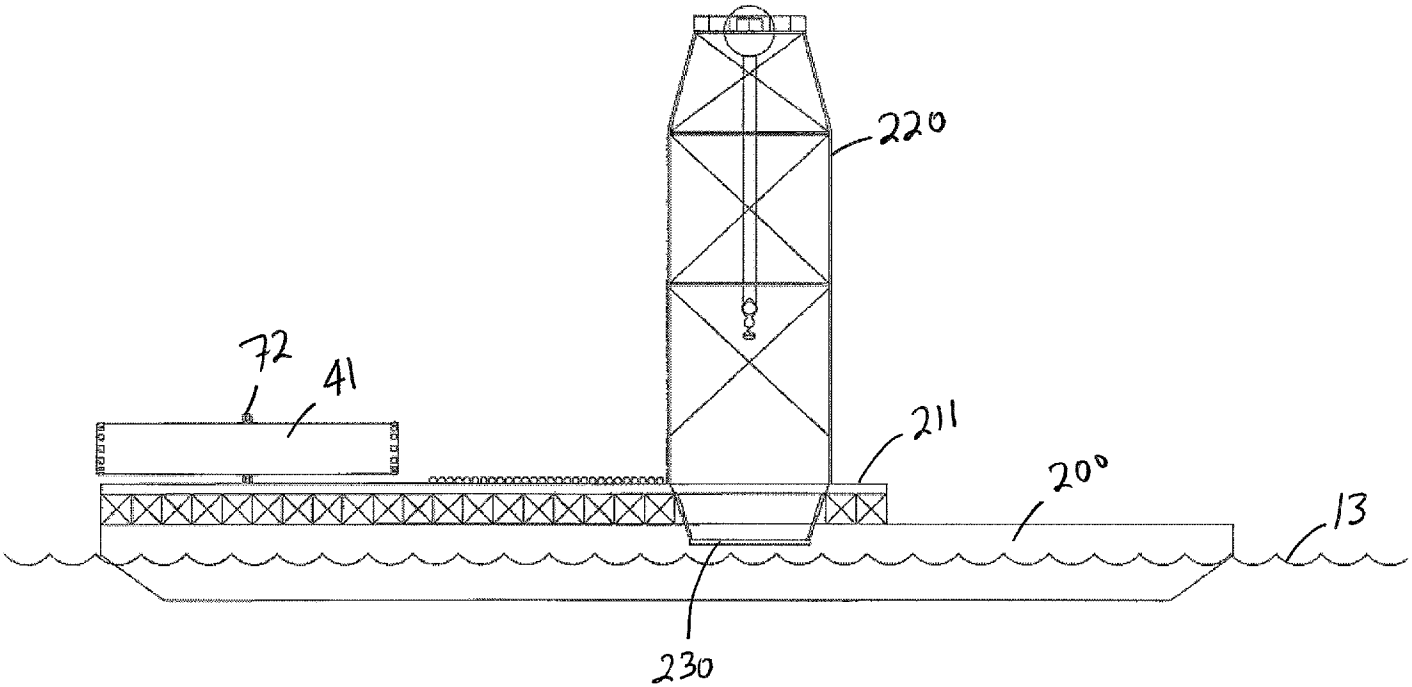

Referring now to FIGS. 17-22, another exemplary method for assembling structure 10 at a desired offshore location is schematically shown. In this embodiment, a floating assembly vessel 200 is employed to assemble and install structure 10 on-site (i.e., at the offshore installation location). As best shown in FIGS. 17 and 18, assembly vessel 100 includes a pair of elongate, parallel pontoons 210, a lifting apparatus 220 positioned between laterally-spaced pontoons 210, and an assembly stabilizer 230 disposed between pontoons 110 immediately below lifting apparatus 220. The top-side of each pontoon 210 comprises a deck 211 that supports, among other things, personnel, equipment, and the various components of offshore structure 10 to be assembled with vessel 200 (e.g., stem modules 41, upper module 20, etc.).

Figure 19:
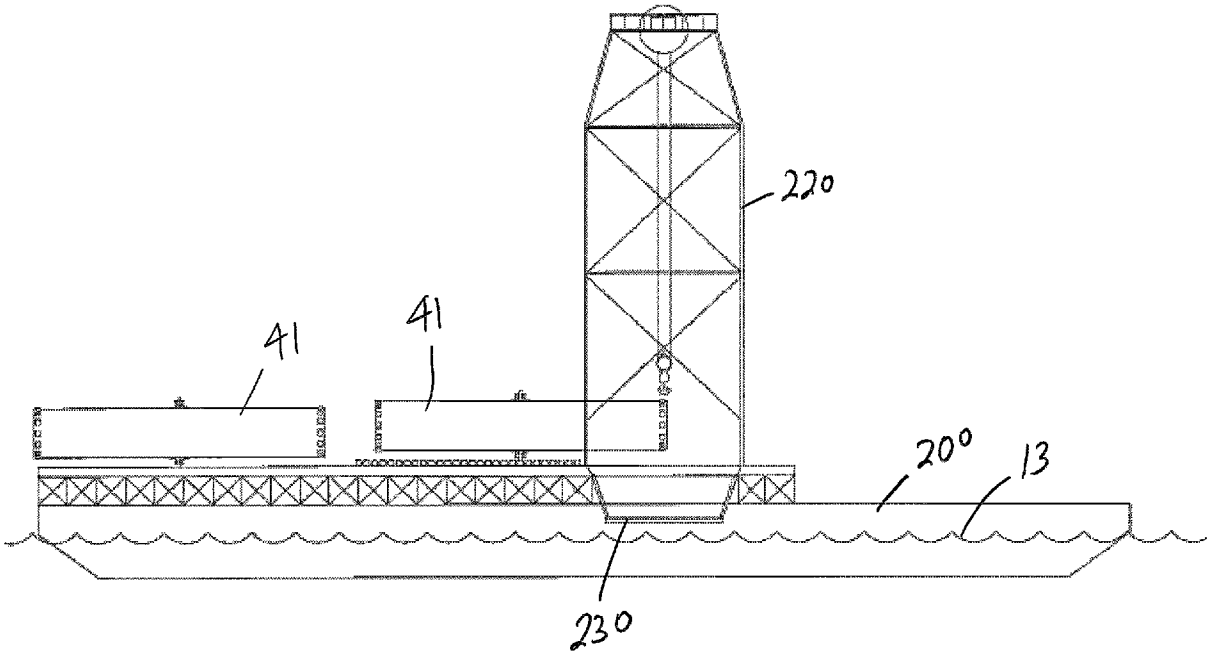
Figure 20:
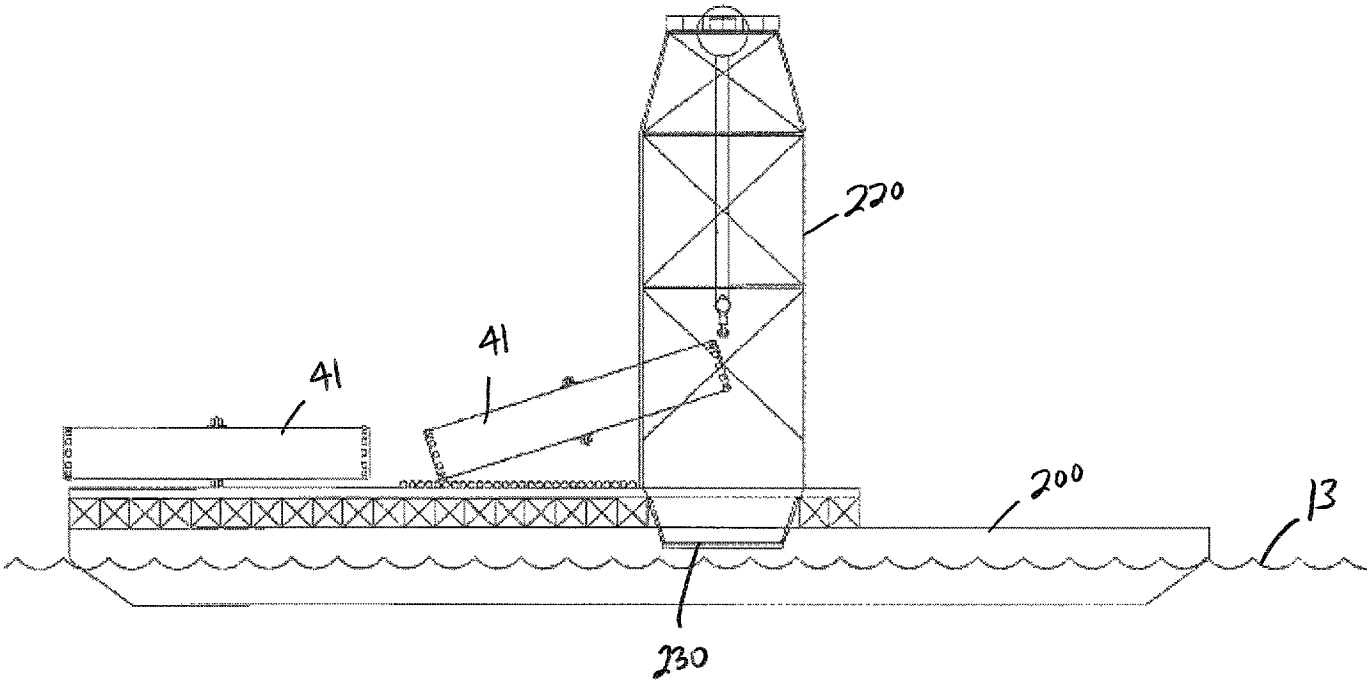
Figure 21:
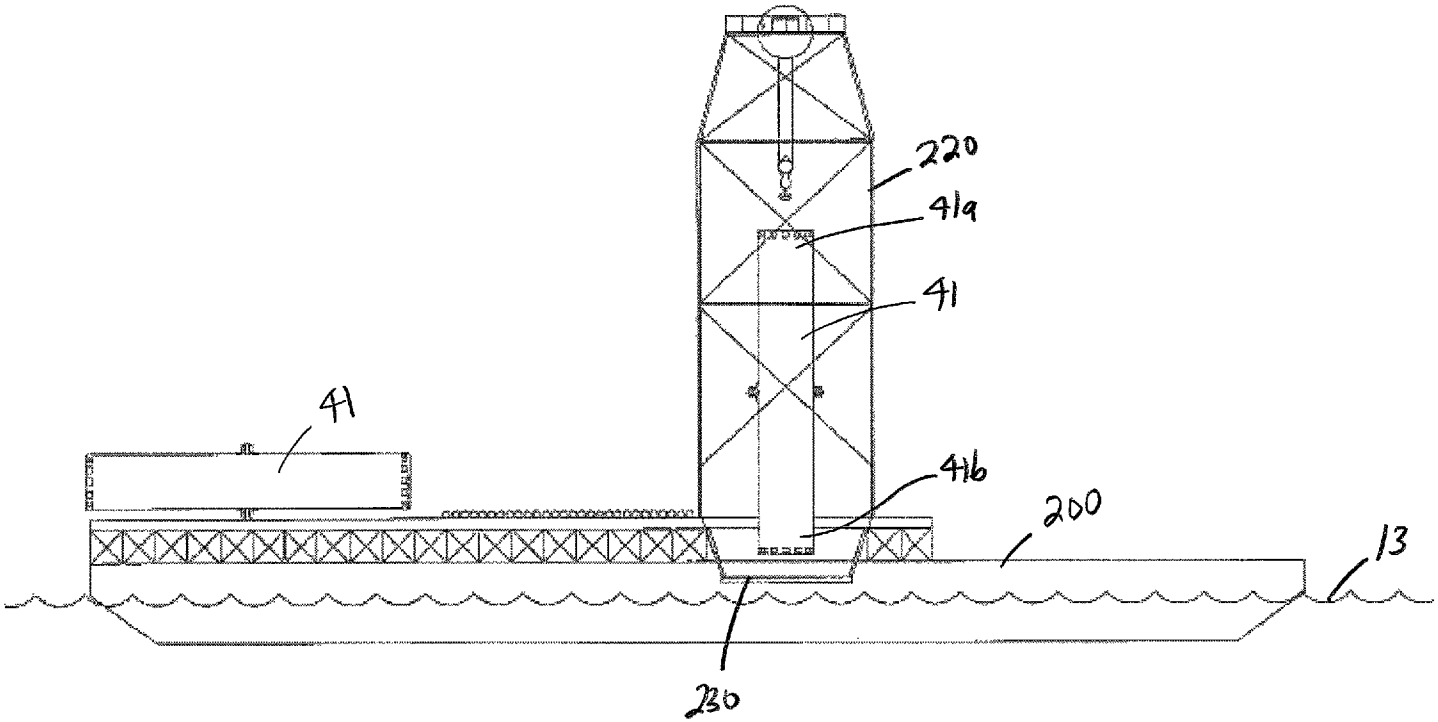
Figure 22:
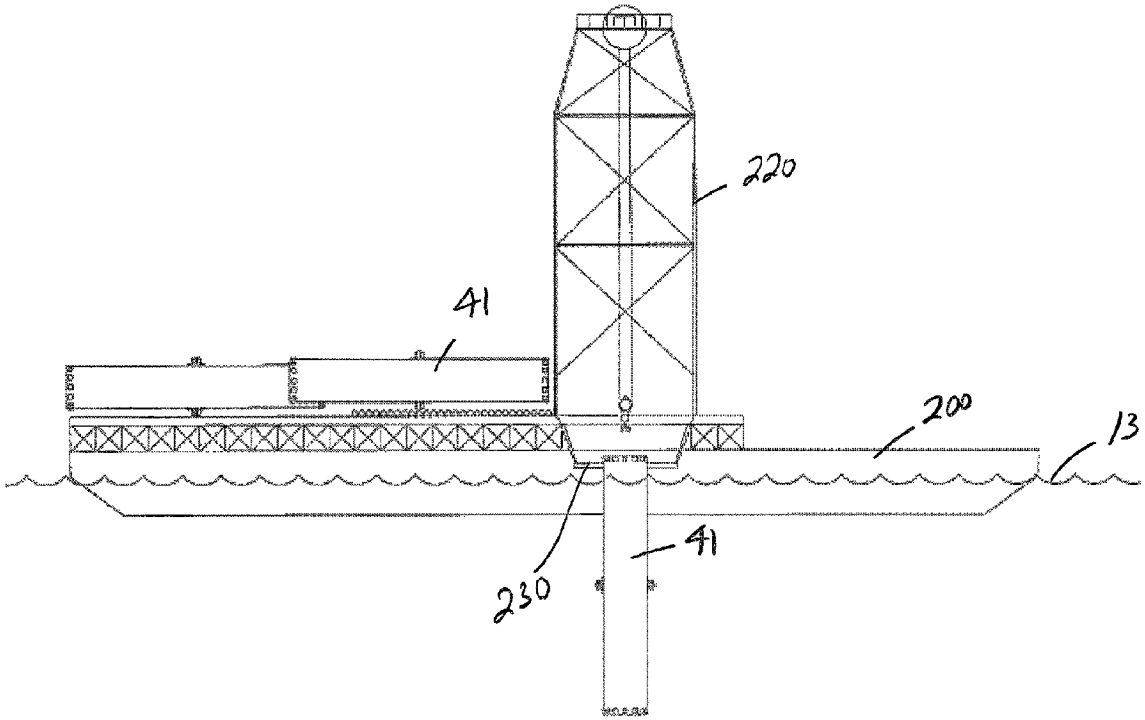

In this embodiment, the components of structure 10 are assembled piece-by-piece in a vertical stack extending subsea from vessel 200. Assembly stabilizer 230 and lifting apparatus 220 work together to align the axially adjacent components one-above-the-other for subsequent coupling. Specifically, as best shown in FIGS. 18-22, structure 10 is constructed from the bottom-up—a first stem module 41 (i.e., the lowermost stem module 41 that will be coupled to anchor 30) is moved from a stowed position shown in FIG. 18 towards lifting apparatus 220 as shown in FIG. 19. Lifting apparatus 220 is coupled to upper end 41*a* and lifts the first stem module 41 to a generally vertical orientation as shown in FIGS. 20 and 21. Next, lifting apparatus 220 lowers first stem module 41 into stabilizer 230, which supports the first stem module 41 as shown in FIG. 22. In particular, first stem module 41 is hung or suspended from stabilizer 230. With the weight of the first stem module 41 supported by stabilizer 230, lifting apparatus 220 disengages the first stem module 41 supported by stabilizer 130, lifts a second stem module 41 into generally vertical orientation axially above stabilizer 230, and then lowers that second stem module 41 axially downward towards the first stem module 41 supported by stabilizer 130.

Figure 23:
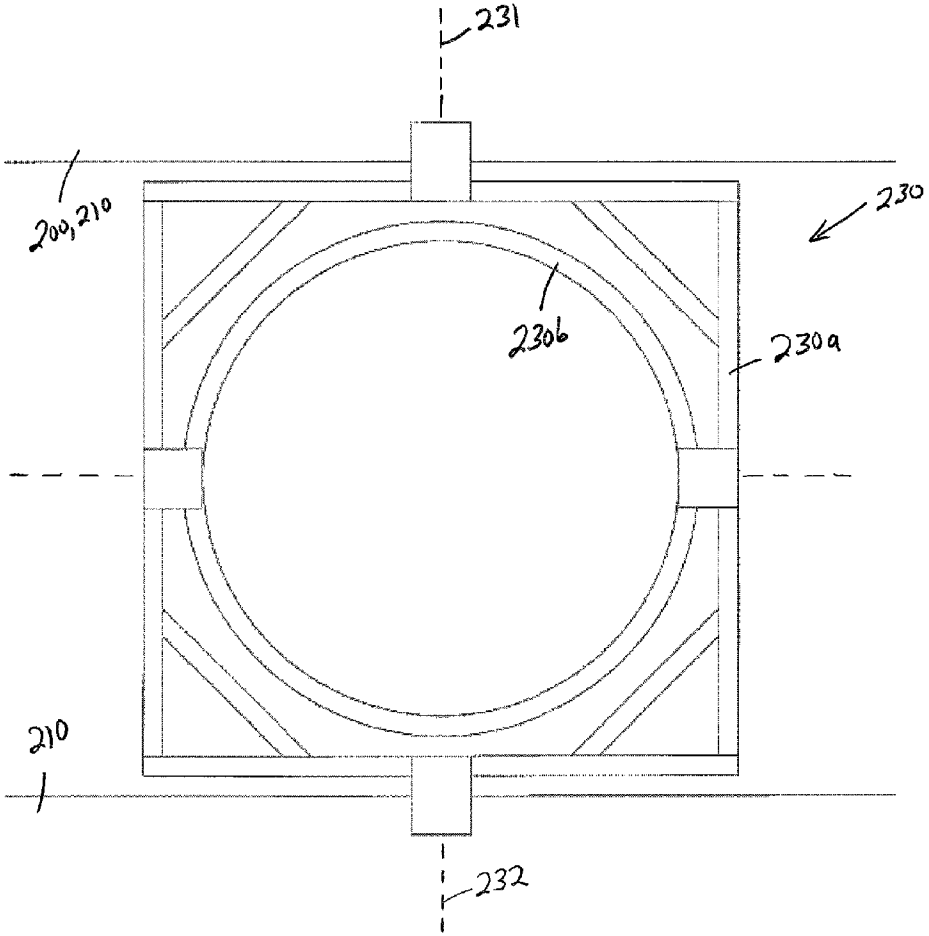
FIG. 23 is a top view of the assembly stabilizer of the assembly vessel of FIG. 17.

As will be understood by one skilled in the art, vessel 200 may list and rock with the waves at the sea surface 13 during offshore assembly. However, stem modules 41 are preferably coaxially aligned such that they may be coupled together end-to-end to form stem 40. In this embodiment, the stem module 41 supported by lifting apparatus 220 generally maintains its vertical orientation since it is hung from lifting apparatus 220 and is free to move relative to vessel 100 under its own weight. Likewise, stem modules 41 supported by stabilizer 230 generally maintain their vertical orientations. In particular, as best shown in FIG. 23, in this embodiment, stabilizer 230 is a double gimbal or two-axis gimbal including a first or outer gimbal 230*a* pivotable relative to vessel 200 about a first axis 231, and a second or inner gimbal 230*b* pivotable relative to vessel 200 about a second axis 232 that is perpendicular to axis 231 in top view. Thus, stabilizer 230 allows stem modules 41 hung therefrom to pivot about two orthogonal axes 231, 232 relative to vessel 100. To account for different sized tubulars and modules (e.g., modules 41), and to releasably engage tubulars and modules, the diameter of inner gimbal 230*b* is adjustable. For example, inner gimbal 230*b* may comprise a split ring or other suitable structure having an adjustable diameter.

Figure 24:
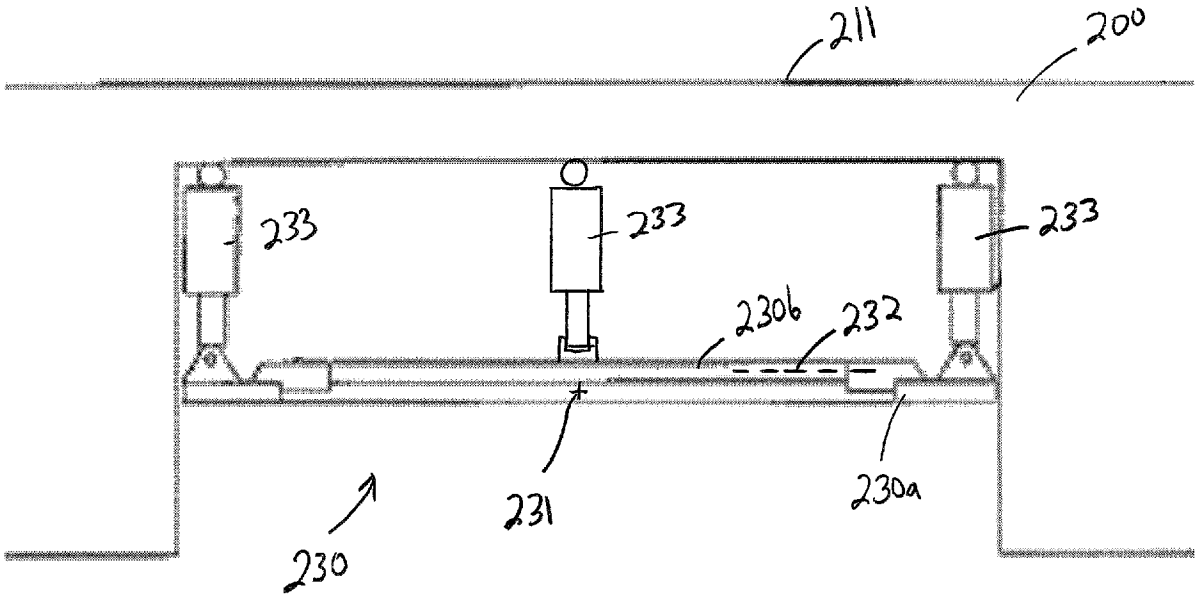
FIG. 24 is a side view of the assembly stabilizer of FIG. 22.

Referring briefly to FIG. 24, the rotation of outer gimbal 230*a* relative to vessel 200 and/or the rotation of inner gimbal 230*b* relative to outer gimbal 230*a* or vessel 200 may be dampened and/or controlled with hydraulic cylinders 233 extending between gimbals 230*a*, 230*b* and vessel 200. Hydraulic cylinders 233 may be passive (i.e., not externally controlled) or active (i.e., externally controlled). For example, hydraulic cylinders 233 may simply dampen the generally free rotation of outer gimbal 230*a* about axis 231 and inner gimbal 230*b* about axis 230*b*, thereby resisting drastic and acute changes in rotations about axes 231, 232. Alternatively, hydraulic cylinders 233 may be controlled by an operator or automated system to force gimbals 230*a*, 230*b* to rotate about axes 231, 232, respectively, in a particular manner, thereby overriding the free movement of stem module 41.

Figure 25:
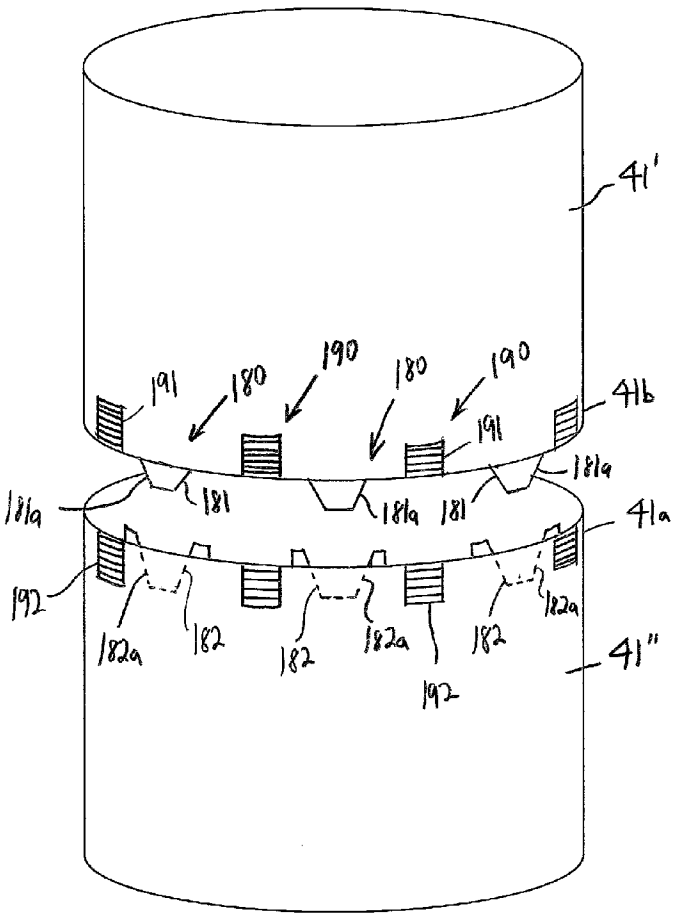
FIG. 25 is an enlarged schematic perspective view of one stem module of the production structure of FIG. 1 being coupled to a second stem module of the production structure of FIG. 1.
Figure 26:
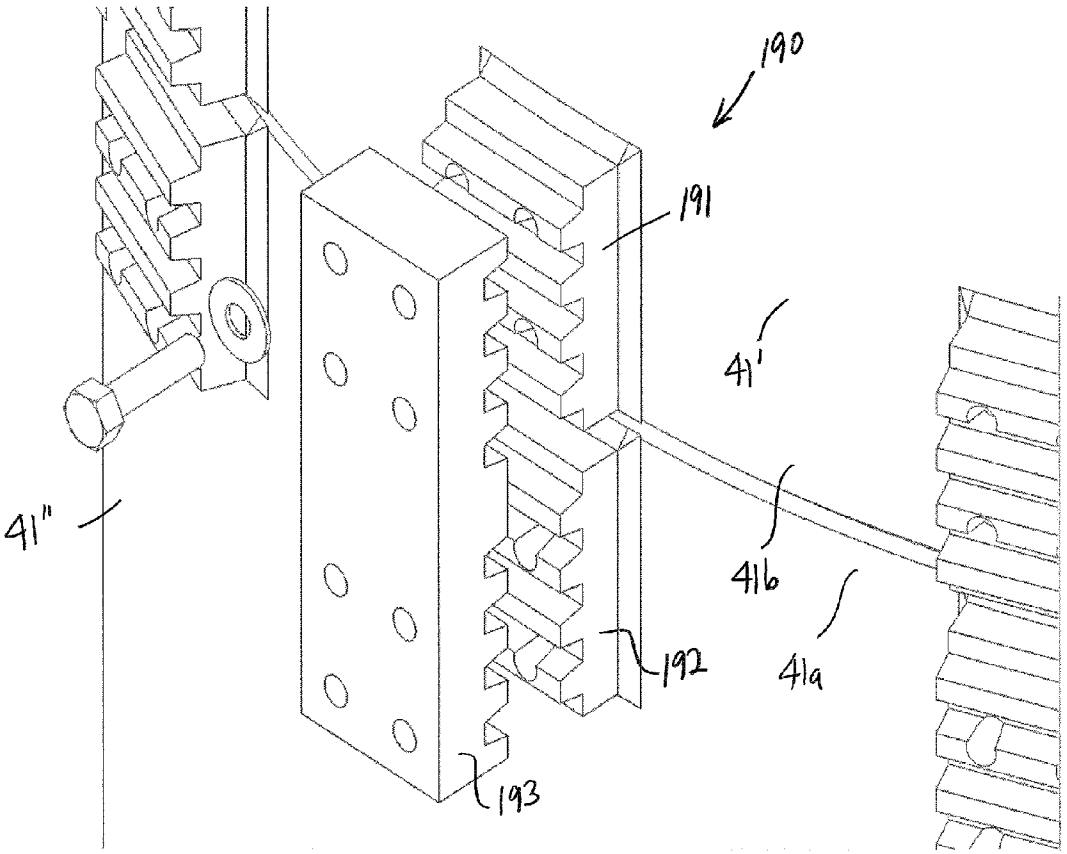
FIGS. 26 and 27 are partial perspective views of the stem modules of FIG. 25 being releasably coupled together with the coupling assemblies of FIG. 25.
Figure 27:
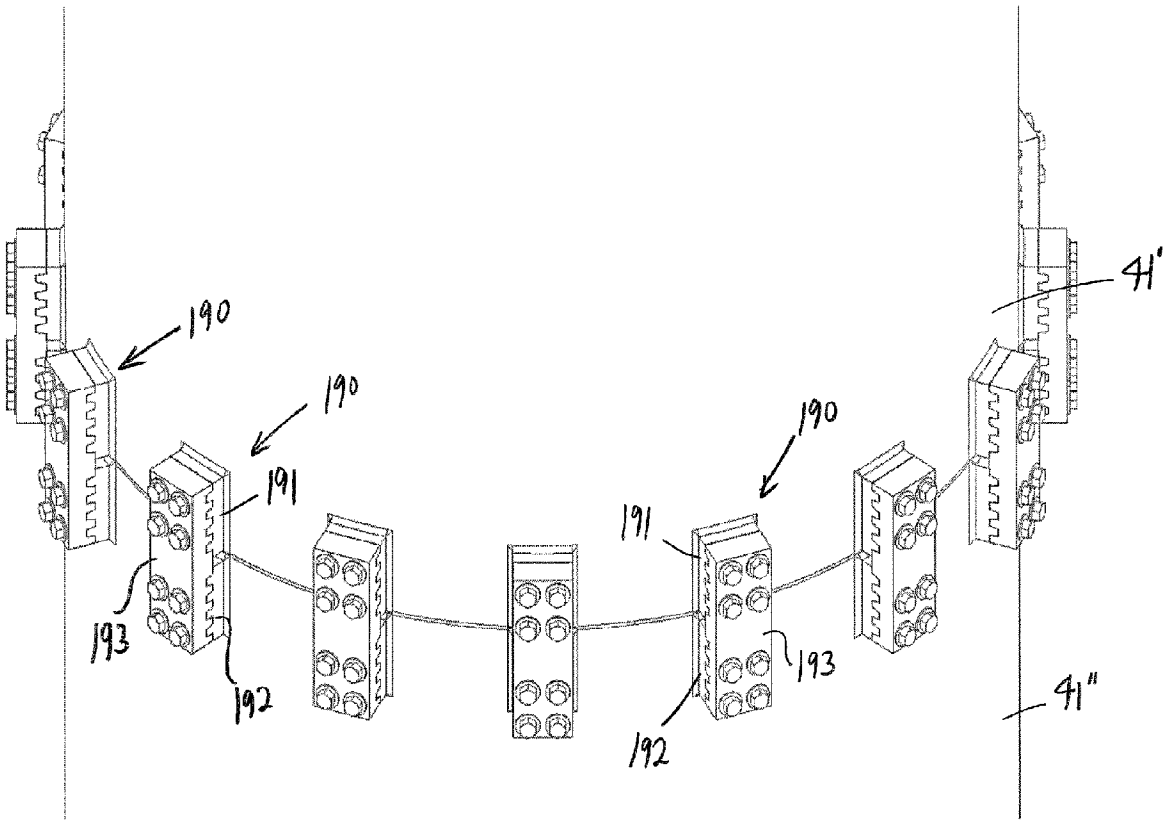

Referring now to FIGS. 25-27, the alignment and end-to-end coupling of an exemplary pair of adjacent stem modules 41 is schematically shown. In FIGS. 25-27, one stem module 41, designated by reference numeral 41', is supported by lifting apparatus 220 and positioned above a second stem module 41, designated by reference numeral 41", which is supported by stabilizer 230. Together, lifting apparatus 220 and stabilizer 230 aid in coaxially aligning of stem modules 41', 41".

With stem modules 41', 41" substantially coaxially aligned, upper stem module 41' is lowered axially onto lower module 41" such that lower end 41*b* of stem module 41' engages upper end 41*a* of stem module 41". A plurality of circumferentially spaced alignment assemblies 180 function to aid in the alignment of modules 41', 41" during an after assembly of modules 41', 41". In particular, assemblies 180 are preferably positioned to circumferentially align coupling members 110 and riser guides 72 on adjacent modules 41. For purposes of clarity, coupling members 110 and riser guides 72 are not shown in FIG. 25.

In this embodiment, each alignment assembly 180 is disposed on the inner surface of tubular 42 and comprise a plurality of circumferentially-spaced male alignment members 181 extending axially downward from lower end 41*b* of upper stem module 41', and a plurality of circumferentially-spaced mating female alignment receptacles 182 along upper end 41*a* of lower stem module 41". Alignment members 181 and alignment receptacles 182 are sized and configured to matingly engage. In this embodiment, members 181 and receptacles 182 are generally V-shaped—alignment members 181 and alignment receptacles 182 include mating sloped guide surfaces 181*a*, 182*a*, respectively, that slidingly engage to guide and funnel members 181 into corresponding receptacles 182. Thus, upper module 41' is positioned above module 41" with riser guides 72 substantially circumferentially aligned and coupling members 110 substantially circumferentially aligned. Next, module 41' is lowered onto module 41", and sliding engagement of surfaces 181*a*, 182*a* guides module 41' to the desired rotational orientation relative to module 41" and ensures proper alignment of riser guides 72 and coupling members 110.

Referring again to FIGS. 25-27, a plurality of circumferentially-spaced coupling assemblies 190 securely couple axially adjacent modules 41 following coaxial alignment of modules 41 using assemblies 180 previously described. In FIGS. 26 and 27, assemblies 190 are shown coupling exemplary modules 41', 41". In this embodiment, each coupling assembly 190 comprises a toothed rack 191 secured to lower end 41*b* of module 41', a toothed rack 192 secured to upper end 41*a* of module 41", and a toothed rack or member 193 that positively engages both racks 191, 192. During assembly, stem module 41' is lowered until lower end 41*b* axially abuts upper end 41*a*. Racks 151, 152 are circumferentially positioned such that rotational alignment of modules 41', 41" with alignment assemblies 180 results in circumferential alignment of one rack 151 with a corresponding rack 152. Next, toothed member 193 is bolted to corresponding sets of circumferentially aligned toothed racks 191, 192 with mating teeth on racks 191, 192 and member 193 intermeshed and positively engaged. One member 193 is coupled to each pair of axially adjacent and circumferentially aligned toothed racks 191, 192 and spans the interface between adjacent modules 41', 41". In this manner, axially adjacent stem modules 41 are aligned and coupled together. This process is repeated to add additional stem modules 41 to form stem 40. It should be appreciated that since stem 40 is formed of multiple modules 41, the overall height of stem 40, and hence the height of structure 10, may be varied by including additional or fewer modules 41 during assembly of stem 40.

Although lifting apparatus 220 and stabilizer 230 are shown and described as being employed during assembly of stem 40, it should be appreciated that lifting apparatus 220 and stabilizer 230 may also be employed to couple upper module 20 to stem 40. Moreover, although assemblies 180 have been shown and described as being used to coaxially align and rotationally orient exemplary modules 41', 41" during assembly of stem 40, and assemblies 190 have been shown and described as coupling exemplary modules 41', 41" during assembly of stem 40, the remaining modules 41 of structure 10 may be assembled in the same manner, and further, upper module 20 may be coupled to stem 40 in the same manner. For example, upper module 20 may be coupled to upper end 40*a* of stem 40 using lifting apparatus 220, stabilizer 230, alignment assemblies 180, and coupling assemblies 190 as previously described. Alternatively, after stem 40 is formed, upper module 20, with deck 60 mounted thereto, may be floated over and aligned with stem 40 as previously described and then coupled to stem 40 using alignment assemblies 180 and coupling assemblies 190. It should be appreciated that adjacent modules 41 coupled together with assemblies 190, as well as upper module 20 coupled to stem 40 with assemblies 190, may be decoupled by simply removing each member 193 from is corresponding toothed racks 191, 192. Accordingly, modules 41 may be described as being releasably coupled, and upper module 20 may be described as being releasably coupled to stem 40.

With stem 40 coupled to upper module 20 (with deck mounted thereto and control system 80 installed), buoyancy control gas conduit 102 is installed and advanced through circumferentially aligned coupling members 110. Next, structure 10 is coupled to anchor 30 and secured to the sea floor as previously described, and systems 80, 100 are employed to adjust the buoyancy of modules 20, 41 to achieve the desired net positive buoyancy for structure 10.

In the manners described above, structure 10 is assembled and coupled to base 30 and the sea floor 12 for subsequent production operations. When production ceases or there is a desire to move structure 10 to a new location, structure 10 may released from base 30 by transitioning locking blocks 48 to the radially withdrawn position with actuators 49, deballasting structure 10 and lifting it from stabbing member 36. Structure 10 may then be floated to the new location. At the new location, structure 10 is coupled to an anchor 30 and the sea floor 12 as previously described. If the depth at the new location is different than that of the previous location, stem modules 41 may be added or removed from stem 40 to adjust the overall height of structure 10 as desired.

In the embodiment of structure 10 previously described, buoyancy is primarily provided by upper module 20 (e.g., air 16 in chambers 26, 27). Some buoyancy is also provided by modules 41 (e.g., air 16 in chambers 44). However, in other embodiments, buoyancy may be provided by a plurality of circumferentially spaced buoyancy cans coupled to the upper portion of the structure (e.g., module 20 of structure 10). In yet other embodiments, stem 40 may be replaced with an elongate truss frame. Such a truss frame is generally transparent to currents and waves, and thus, reduces loads on the production structure, but adds weight and does not provide any buoyancy. Accordingly, in such embodiments, the upper module (e.g., module 20) and/or buoyancy cans are relied on to provide sufficient buoyancy to the production structure.

In the manner described, embodiments described herein provide a height adjustable offshore structure 10 that may be used in depths greater than those to which jackup platforms and fixed platforms may be used. Further, since embodiments of structure 10 described herein include a single point mooring and adjustable buoyancy, they may be moved from location-to-location with relative ease and low expense.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simply subsequent reference to such steps.

What is claimed is:

1. An offshore structure, comprising:

a base configured to be secured to the sea floor;

an elongate stem having a longitudinal axis, a first end distal the base and a second end pivotally coupled to the base, wherein the stem comprises a plurality of stem modules coupled together end-to-end, wherein each stem module includes a variable ballast chamber;

an upper module coupled to the first end of the stem, wherein the upper module includes a variable ballast chamber;

a first ballast control conduit in fluid communication with the variable ballast chamber of the upper module, wherein the first ballast control conduit is configured to supply a gas to the variable ballast chamber of the upper module and vent the gas from the variable ballast chamber of the upper module;

a second ballast control conduit moveably coupled to the stem, wherein the second ballast control conduit is configured to supply a gas to one or more of the variable ballast chambers of the stem modules; and a deck mounted to the upper module.

2. The offshore structure of claim 1, wherein the upper module includes a port in fluid communication with the variable ballast chamber of the upper module, wherein the port is configured to allow water to flow into and out of the variable ballast chamber of the upper module from the surrounding environment.

3. The offshore structure of claim 2, wherein the first ballast control conduit has an end disposed within the variable ballast chamber.

4. The offshore structure of claim 3, wherein the end of the first ballast control conduit is positioned proximal an upper end of the variable ballast chamber of the upper module, and wherein the port is positioned proximal a lower end of the variable ballast chamber of the upper module.

5. The offshore structure of claim 1, wherein the anchor is a suction pile including a suction skirt.

6. The offshore structure of claim 5, further comprising a fluid conduit in fluid communication with a cavity defined by the suction skirt, wherein the fluid conduit is configured to vent the cavity, pump a fluid into the cavity, or draw a fluid from the cavity.

7. The offshore structure of claim 1, wherein each stem module includes a port in fluid communication with the variable ballast chamber of the upper module, wherein the port in each stem module is configured to allow water to flow into and out of the variable ballast chamber of the corresponding stem module from the surrounding environment.

8. The offshore structure of claim 1, wherein the second end of the stem is releasably coupled to the base.

9. A method for producing one or more offshore wells, comprising:

(a) transporting an elongate stem and an upper module offshore, wherein the upper module includes a variable ballast chamber, wherein the stem comprises a plurality stem modules coupled together end-to-end, and wherein each stem module includes a variable ballast chamber;

(b) transitioning the stem from a horizontal orientation to a vertical orientation;

(c) attaching the upper module to an upper end of the stem to form a tower;

(d) ballasting the tower;

(e) moving a ballast control conduit along the stem after (c) to ballast or deballast one or more of the variable ballast chambers of the stem modules; and (f) pivotally coupling the tower to an anchor disposed at the sea floor at a first offshore installation site.

10. The method of claim 9, further comprising:

(g) deballasting the tower.

11. The method of claim 10, wherein the tower is net buoyant after (g) and the stem is in tension.

12. The method of claim 11, wherein (d) comprises flowing variable ballast into the variable ballast chamber of the upper module; and wherein (g) comprises flowing air into the variable ballast chamber of the upper module and flowing variable ballast out of the variable ballast chamber of the upper module.

13. The method of claim 9, wherein the anchor is a suction pile including a suction skirt.

14. The method of claim 13, further comprising:

penetrating the sea floor with the suction skirt; and pumping a fluid from a cavity within the suction skirt while penetrating the sea floor with the suction skirt.

15. The method of claim 9, wherein (f) comprises releasably coupling the tower to the anchor.

16. The method of claim 10, wherein (d) comprises flowing variable ballast into one or more of the variable ballast chambers of the stem modules; and wherein (g) comprises flowing air into one or more of the variable ballast chambers of the stem modules and flowing variable ballast out of one or more of the variable ballast chambers of the stem modules.

17. The method of claim 9, wherein (d) comprises allowing a gas in the variable ballast chamber of the upper module to vent and allowing water to flow into the variable ballast chamber of the upper module through a port in the upper module.

18. The method of claim 9, further comprising:

(g) decoupling the tower from the anchor at the first offshore installation site;

(h) moving the tower from the first offshore installation site to a second offshore installation site after (g);

(i) ballasting the tower after (h);

(j) pivotally coupling the tower to an anchor disposed at the sea floor at the first offshore installation site after (i).

19. An offshore structure, comprising:

a tower having a longitudinal axis, an upper end, and a lower end opposite the upper end;

wherein the tower comprises an elongate stem extending from the lower end, an upper module coupled to the stem, and a deck mounted to the upper module at the upper end;

wherein the upper module is net buoyant;

a conduit coupling member extending radially outward from the stem, the conduit coupling member including a guide tubular coupled to the stem;

a first ballast control system configured to adjust the buoyancy of the upper module, the first ballast control system including a first conduit;

a second ballast control system configured to adjust the buoyancy of the stem, the second ballast control system including a second conduit configured to be moveably received by the guide tubular of the conduit coupling member; and an anchor configured to be secured to the sea floor, wherein the anchor is pivotally and releasably coupled to the lower end of the tower.

20. The offshore structure of claim 19, wherein the first conduit has a lower end disposed within a first ballast chamber in the upper module and an upper end positioned external the ballast chamber;

wherein the guide tubular of the conduit coupling member is in fluid communication with a second ballast chamber in the stem through a connection conduit extending radially from the conduit guide tubular to the stem.

21. The offshore structure of claim 20, wherein the first conduit is configured to vent air from the first ballast chamber and supply compressed air to the first ballast chamber;

wherein the second conduit is configured to vent air from the second ballast chamber and supply compressed air to the second ballast chamber.

22. The offshore structure of claim 19, wherein the stem comprises a plurality of stem modules coupled together end-to-end;

wherein each stem module is releasably coupled to an adjacent stem module with a plurality of circumferentially spaced coupling assemblies, wherein each coupling assembly includes a first toothed rack coupled to one stem module, a second toothed rack coupled to an adjacent stem module, and a third toothed rack positively engaging the first toothed rack and the second toothed rack.

* * * * *